US011847951B2

(12) United States Patent
Lee et al.

(10) Patent No.: US 11,847,951 B2
(45) **Date of Patent: *Dec. 19, 2023**

(54) GAMMA VOLTAGE GENERATOR, DISPLAY DRIVER, DISPLAY DEVICE AND METHOD OF GENERATING A GAMMA VOLTAGE

(71) Applicant: Samsung Display Co., Ltd., Yongin-Si (KR)

(72) Inventors: Sanghyun Lee, Seongnam-si (KR); Dae-Sik Lee, Hwaseong-si (KR); Keunoh Kang, Uijeongbu-si (KR); Siduk Sung, Hwaseong-si (KR); Songyi Han, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/979,028

(22) Filed: Nov. 2, 2022

(65) Prior Publication Data

US 2023/0368719 A1 Nov. 16, 2023

(30) Foreign Application Priority Data

May 11, 2022 (KR) ..... 10-2022-0057807

(51) Int. Cl.
*G09G 3/20* (2006.01)

(52) U.S. Cl.
CPC ..... *G09G 3/2011* (2013.01); *G09G 2310/027* (2013.01); *G09G 2320/0276* (2013.01); *G09G 2320/0673* (2013.01)

(58) Field of Classification Search
CPC ..... G09G 3/2011; G09G 2310/027; G09G 2320/0276; G09G 2320/0673;
(Continued)

(56) References Cited

U.S. PATENT DOCUMENTS 7,253,664 B2 * 8/2007 Yeh ..... H03F 1/34 341/120
8,344,978 B2 * 1/2013 Kim ..... G09G 3/20 345/89
(Continued)

FOREIGN PATENT DOCUMENTS

KR 10-2012-0072558 A 7/2012
KR 10-1311300 B1 9/2013
KR 10-2021-0081785 A 7/2021

*Primary Examiner* — Michael J Jansen, II
(74) *Attorney, Agent, or Firm* — Innovation Counsel LLP

(57) ABSTRACT

A gamma voltage generator within a display device includes a plurality of gamma generation circuits that respectively generate a plurality of gamma voltages. At least one gamma generation circuit includes an input circuit configured to receive a first reference voltage and a second reference voltage, a reference voltage select circuit configured to select a reference voltage among the first reference voltage and the second reference voltage by comparing a gamma voltage generated by the at least one gamma generation circuit with the first reference voltage and the second reference voltage, a digital-to-analog conversion circuit configured to generate an analog voltage corresponding to a gamma code based on the reference voltage selected by the reference voltage select circuit, and an output circuit configured to output the gamma voltage based on the analog voltage.

22 Claims, 13 Drawing Sheets

(58) Field of Classification Search
CPC .. G09G 3/2092; G09G 3/3225; G09G 3/3275; G09G 2300/0439; G09G 2310/08; G09G 3/2007; G09G 2320/0223; G09G 2320/0233; G09G 2330/028; G09G 3/2003; G09G 3/3208; G09G 2300/0828
See application file for complete search history.

(56) References Cited

U.S. PATENT DOCUMENTS 8,730,223 B2 * 5/2014 Kim ..... G09G 3/3696 345/204
9,530,378 B2 * 12/2016 Liu ..... G09G 3/3688
10,600,378 B2 * 3/2020 Ito ..... G02F 1/13306
10,854,127 B2 * 12/2020 You ..... G09G 3/3696
11,120,772 B1 * 9/2021 Hsieh ..... G05F 3/08
11,393,398 B2 * 7/2022 Lee ..... G09G 3/2007
11,450,279 B2 * 9/2022 Lee ..... G09G 3/3275
11,488,505 B2 * 11/2022 Piao ..... G09G 3/20
2006/0049868 A1 * 3/2006 Yeh ..... H03F 3/45475 327/538
2008/0291190 A1 * 11/2008 Kim ..... G09G 3/3648 345/211
2009/0046083 A1 * 2/2009 Kim ..... G09G 3/20 345/204
2010/0321361 A1 * 12/2010 Weng ..... G09G 3/3688 345/211
2012/0206506 A1 * 8/2012 Kim ..... G09G 3/20 345/690
2013/0241501 A1 * 9/2013 Chang ..... G09G 3/36 320/166
2014/0097802 A1 * 4/2014 Tang ..... G09G 3/3696 320/166
2015/0364077 A1 * 12/2015 Liu ..... G09G 3/3688 345/691
2019/0088219 A1 * 3/2019 Ito ..... B60K 35/00
2020/0312215 A1 * 10/2020 You ..... G09G 3/2011
2021/0183293 A1 * 6/2021 Piao ..... G09G 3/20
2021/0201801 A1 * 7/2021 Lee ..... G09G 3/3275
2021/0256909 A1 * 8/2021 Lee ..... G09G 3/3233

* cited by examiner (VOMAN ≤ VREF1)

(VREF1 < VGMAN ≤ VREF2)

(VREF1 > VREF2)

GAMMA VOLTAGE GENERATOR, DISPLAY DRIVER, DISPLAY DEVICE AND METHOD OF GENERATING A GAMMA VOLTAGE

CROSS-REFERENCE TO RELATED APPLICATION(S)

This application claims priority under 35 USC § 119 to Korean Patent Application No. 10-2022-0057807, filed on May 11, 2022, in the Korean Intellectual Property Office (KIPO), the content of which is herein incorporated by reference in its entirety.

BACKGROUND

1. Field

Embodiments of the present inventive concept relate to a display device, and more particularly to a gamma voltage generator, a display driver including the gamma voltage generator, and a method of generating a gamma voltage by the gamma voltage generator.

2. Description of the Related Art

A gamma voltage generator of a display device may receive a reference voltage, and may generate at least one gamma voltage (or at least one gamma reference voltage) by using the reference voltage. A data driver may receive the gamma voltage from the gamma voltage generator, may generate a plurality of gray voltages respectively corresponding to a plurality of gray levels based on the gamma voltage, may select gray voltages corresponding to image data among the plurality of gray voltages, and may provide the selected gray voltages as data voltages to pixels of a display panel.

However, in a case where the reference voltage has a ripple or fluctuates, the gamma voltage also may have a ripple or may fluctuate. Further, in a case where the gamma voltage has the ripple or fluctuates, the data voltages may have a ripple or may fluctuate, and thus a flicker may occur in a display device.

SUMMARY

Some embodiments provide a gamma voltage generator capable of reducing a ripple or a fluctuation of a gamma voltage.

Some embodiments provide a display driver including a gamma voltage generator capable of reducing a ripple or a fluctuation of a gamma voltage.

Some embodiments provide a display device including a gamma voltage generator capable of reducing a ripple or a fluctuation of a gamma voltage.

Some embodiments provide a method of generating a gamma voltage capable of reducing a ripple or a fluctuation of the gamma voltage.

According to embodiments, there is provided a gamma voltage generator including a plurality of gamma generation circuits configured to generate a plurality of gamma voltages, respectively. At least one gamma generation circuit of the plurality of gamma generation circuits includes an input circuit configured to receive a first reference voltage and a second reference voltage, a reference voltage select circuit configured to select a reference voltage among the first reference voltage and the second reference voltage by comparing a gamma voltage generated by the at least one gamma generation circuit with at least one of the first reference voltage and the second reference voltage, a digital-to-analog conversion circuit configured to generate an analog voltage corresponding to a gamma code based on the reference voltage selected by the reference voltage select circuit, and an output circuit configured to output the gamma voltage based on the analog voltage.

In embodiments, the at least one gamma generation circuit may selectively receive two or more reference voltages including the first reference voltage and the second reference voltage, and each of remaining gamma generation circuits other than the at least one gamma generation circuit among the plurality of gamma generation circuits may receive a fixed reference voltage.

In embodiments, the second reference voltage may be higher than the first reference voltage. The reference voltage select circuit may select the first reference voltage among the first reference voltage and the second reference voltage in a case where the gamma voltage is less than or equal to the first reference voltage, and may select the second reference voltage among the first reference voltage and the second reference voltage in a case where the gamma voltage is greater than the first reference voltage.

In embodiments, the first reference voltage may be a band gap reference (BGR) voltage that is generated by a BGR circuit, and the second reference voltage may be a logic voltage that is higher than the BGR voltage and that is supplied to a logic circuit.

In embodiments, the input circuit may include a first input buffer configured to receive the first reference voltage through an input terminal and to output the first reference voltage through an output terminal, a second input buffer configured to receive the second reference voltage through an input terminal and to output the second reference voltage through an output terminal, a reference voltage control switch configured to selectively couple the output terminal of the first input buffer or the output terminal of the second input buffer to the digital-to-analog conversion circuit in response to a reference voltage control signal.

In embodiments, the digital-to-analog conversion circuit may include a resistor string configured to generate a plurality of analog voltages by dividing the selected reference voltage, and an analog voltage select circuit configured to select one of the plurality of analog voltages in response to the gamma code.

In embodiments, the output circuit may include an output buffer configured to receive the analog voltage, and to output the analog voltage as the gamma voltage.

In embodiments, the second reference voltage may be higher than the first reference voltage. In a case where the gamma voltage is less than or equal to the first reference voltage, the at least one gamma generation circuit may not apply a gain of the output circuit and may generate the gamma voltage by using the first reference voltage. In a case where the gamma voltage is greater than the first reference voltage and less than or equal to the second reference voltage, the at least one gamma generation circuit may not apply the gain of the output circuit and may generate the gamma voltage by using the second reference voltage. In a case where the gamma voltage is greater than the second reference voltage, the at least one gamma generation circuit may generate the gamma voltage by using the second reference voltage and by applying the gain of the output circuit.

In embodiments, the reference voltage select circuit may output the gamma voltage substantially the same as the analog voltage in a case where the gain of the output circuit is not applied, and may output the gamma voltage generated by multiplying the analog voltage by the gain of the output circuit in a case where the gain of the output circuit is applied.

In embodiments, the at least one gamma generation circuit may further include a gain control circuit configured to control the output circuit such that a gain of the output circuit is selectively applied by comparing the gamma voltage with the second reference voltage.

In embodiments, the gain control circuit may control the output circuit to output the analog voltage as the gamma voltage in a case where the gamma voltage is less than or equal to the second reference voltage, and may control the output circuit to generate the gamma voltage by multiplying the analog voltage by the gain of the output circuit in a case where the gamma voltage is greater than the second reference voltage.

In embodiments, the output circuit may include an output buffer including a first input terminal for receiving the analog voltage, a second input terminal coupled to a feedback node, and an output terminal coupled to an output node at which the gamma voltage is output, a first resistor including a first terminal coupled to the output node, and a second terminal coupled to the feedback node, a second resistor including a first terminal coupled to the feedback node, and a second terminal, and a gain application switch configured to selectively couple the second terminal of the second resistor to a power supply voltage line in response to a gain application signal output from the gain control circuit.

In embodiments, the input circuit may include an input buffer including an input terminal, and an output terminal coupled to the digital-to-analog conversion circuit, and a reference voltage select switch configured to selectively couple a line of the first reference voltage or a line of the second reference voltage to the input terminal of the input buffer in response to a reference voltage control signal.

In embodiments, the input circuit may receive L reference voltages including the first reference voltage and the second reference voltage, where L is an integer greater than 1, and the reference voltage select circuit may select the reference voltage among the L reference voltages by comparing the gamma voltage with the L reference voltages.

In embodiments, the at least one gamma generation circuit may further include a gain control circuit configured to generate a gain value adjustment signal for adjusting a value of a gain of the output circuit, and a gain application signal for selectively applying the gain of the output circuit by comparing the gamma voltage with the second reference voltage.

In embodiments, the output circuit may include an output buffer including a first input terminal for receiving the analog voltage, a second input terminal coupled to a feedback node, and an output terminal coupled to an output node at which the gamma voltage is output, a first resistor including a first terminal coupled to the output node, and a second terminal coupled to the feedback node, and having a variable resistance value that is changed in response to the gain value adjustment signal, a second resistor including a first terminal coupled to the feedback node, and a second terminal, and a gain application switch configured to selectively couple the second terminal of the second resistor to a power supply voltage line in response to the gain application signal.

In embodiments, the plurality of gamma generation circuits may be N gamma generation circuits, where N is an integer greater than 1. Each of M gamma generation circuits among the N gamma generation circuits may selectively receive two or more reference voltages, where M is an integer greater than 0 and less than N, and each of N-M gamma generation circuits other than the M gamma generation circuits among the N gamma generation circuits may receive a fixed reference voltage.

According to embodiments, there is provided a display driver for driving a display panel. The display driver includes a gamma voltage generator including a plurality of gamma generation circuits that respectively generate a plurality of gamma voltages, and a data driver configured to generate data voltages based on the plurality of gamma voltages and to provide the data voltages to the display panel. At least one gamma generation circuit of the plurality of gamma generation circuits includes an input circuit configured to receive a first reference voltage and a second reference voltage, a reference voltage select circuit configured to select a reference voltage among the first reference voltage and the second reference voltage by comparing a gamma voltage generated by the at least one gamma generation circuit with the first reference voltage and the second reference voltage, a digital-to-analog conversion circuit configured to generate an analog voltage corresponding to a gamma code based on the reference voltage selected by the reference voltage select circuit, and an output circuit configured to output the gamma voltage based on the analog voltage.

In embodiments, the second reference voltage may be higher than the first reference voltage. The at least one gamma generation circuit may further include a gain control circuit configured to control the output circuit such that a gain of the output circuit is selectively applied by comparing the gamma voltage with the second reference voltage. In a case where the gamma voltage is less than or equal to the first reference voltage, the at least one gamma generation circuit may generate the gamma voltage by using the first reference voltage. In a case where the gamma voltage is greater than the first reference voltage and less than or equal to the second reference voltage, the at least one gamma generation circuit may generate the gamma voltage by using the second reference voltage. In a case where the gamma voltage is greater than the second reference voltage, the at least one gamma generation circuit may generate the gamma voltage by using the second reference voltage and by applying the gain of the output circuit.

According to embodiments, there is provided a display device including a display panel including a plurality of pixels, a scan driver configured to provide scan signals to the plurality of pixels, a gamma voltage generator including a plurality of gamma generation circuits that respectively generate a plurality of gamma voltages, a data driver configured to generate data voltages based on the plurality of gamma voltages, and to provide the data voltages to the plurality of pixels, and a controller configured to control the scan driver, the gamma voltage generator and the data driver. At least one gamma generation circuit of the plurality of gamma generation circuits includes an input circuit configured to receive a first reference voltage and a second reference voltage, a reference voltage select circuit configured to select a reference voltage among the first reference voltage and the second reference voltage by comparing a gamma voltage generated by the at least one gamma generation circuit with the first reference voltage and the second reference voltage, a digital-to-analog conversion circuit configured to generate an analog voltage corresponding to a gamma code based on the reference voltage selected by the reference voltage select circuit, and an output circuit configured to output the gamma voltage based on the analog voltage.

In embodiments, the second reference voltage may be higher than the first reference voltage. The at least one gamma generation circuit may further include a gain control circuit configured to control the output circuit such that a gain of the output circuit is selectively applied by comparing the gamma voltage with the second reference voltage. In a case where the gamma voltage is less than or equal to the first reference voltage, the at least one gamma generation circuit may generate the gamma voltage by using the first reference voltage. In a case where the gamma voltage is greater than the first reference voltage and less than or equal to the second reference voltage, the at least one gamma generation circuit may generate the gamma voltage by using the second reference voltage. In a case where the gamma voltage is greater than the second reference voltage, the at least one gamma generation circuit may generate the gamma voltage by using the second reference voltage and by applying the gain of the output circuit.

According to embodiments, there is provided a method of generating a gamma voltage. In the method, a first reference voltage and a second reference voltage are received, a gamma voltage is compared with at least one of the first reference voltage and the second reference voltage, the gamma voltage is generated by using the first reference voltage in a case where the gamma voltage is less than or equal to the first reference voltage, the gamma voltage is generated by using the second reference voltage in a case where the gamma voltage is greater than the first reference voltage and less than or equal to the second reference voltage, and the gamma voltage is generated by using the second reference voltage and by applying a gain of an output circuit in a case where the gamma voltage is greater than the second reference voltage.

As described above, in a gamma voltage generator, a display driver, a display device and a method of generating a gamma voltage, at least one gamma generation circuit that generates at least one gamma voltage of a plurality of gamma voltages generated by the gamma voltage generator may receive a plurality of reference voltages, may select one reference voltage among the plurality of reference voltages by comparing the at least one gamma voltage with the plurality of reference voltages, and may generates the at least one gamma voltage by using the selected one reference voltage. Accordingly, a ripple or a fluctuation of the at least one gamma voltage may be reduced, a ripple or a fluctuation of data voltages generated based on the at least one gamma voltage may be reduced, and thus a flicker of the display device may be reduced.

BRIEF DESCRIPTION OF THE DRAWINGS

Illustrative, non-limiting embodiments will be more clearly understood from the following detailed description in conjunction with the accompanying drawings.

DETAILED DESCRIPTION OF THE EMBODIMENTS

Hereinafter, embodiments of the present inventive concept will be explained in detail with reference to the accompanying drawings.

Figure 1:
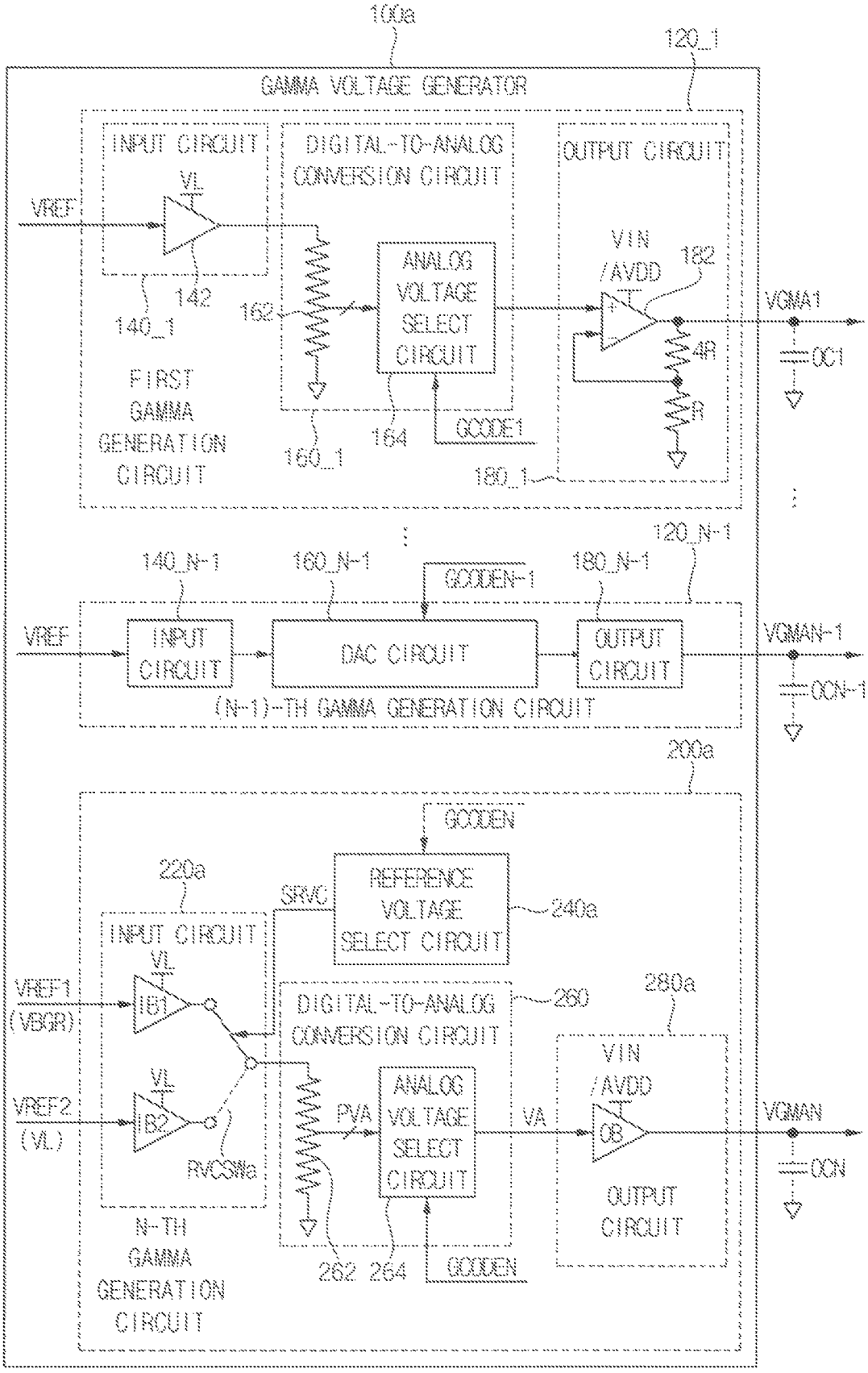
FIG. 1 is a block diagram illustrating a gamma voltage generator according to embodiments.

FIG. 1 is a block diagram illustrating a gamma voltage generator according to embodiments.

Referring to FIG. 1, a gamma voltage generator 100*a* according to embodiments may include a plurality of gamma generation circuits 120_1, . . . , 120_N−1 and 200*a* that respectively generate a plurality of gamma voltages VGMA1, . . . , VGMAN−1 and VGMAN.

At least one gamma generation circuit 200*a* of the plurality of gamma generation circuits 120_1, . . . , 120_N−1 and 200*a* may receive two or more reference voltages VREF1 and VREF2, and may generate a gamma voltage VGMAN by selectively using the two or more reference voltages VREF1 and VREF2. Further, each of the remaining gamma generation circuits 120_1, . . . , 120_N−1 other than the least one gamma generation circuit 200*a* among the plurality of gamma generation circuits 120_1, . . . , 120_N−1 and 200*a* may receive a fixed reference voltage VREF, and may generate a gamma voltage VGMA1, . . . , VGMAN−1 by using the fixed reference voltage VREF. In some embodiments, as illustrated in FIG. 1, the gamma voltage generator 100*a* may include first through N-th gamma generation circuits 120_1, . . . , 120_N−1 and 200*a* that respectively generate first through N-th gamma voltages VGMA1, . . . , VGMAN−1 and VGMAN, where N is an integer greater than 1, the first through (N−1)-th gamma generation circuits 120_1, . . . , 120_N−1 may generate the first through (N−1)-th gamma voltages VGMA1, . . . , VGMAN−1 by using the fixed reference voltage VREF, and the N-th gamma generation circuit 200*a* (e.g., the gamma generation circuit 200*a* that generates the lowest gamma voltage VGMAN among the first through N-th gamma voltages VGMA1 through VGMAN) may generate the N-th gamma voltage VGMAN by selectively using the two or more reference voltages VREF1 and VREF2.

Each of the first through (N−1)-th gamma generation circuits 120_1, . . . , 120_N−1 may include an input circuit 140_1, . . . , 140_N−1, a digital-to-analog conversion (DAC) circuit 160_1, . . . , 160_N−1 and an output circuit 180_1, . . . , 180_N−1.

The input circuit 140_1, . . . , 140_N−1 of each of the first through (N−1)-th gamma generation circuits 120_1, . . . , 120_N−1 may receive a reference voltage VREF, and may provide the reference voltage VREF to the DAC circuit 160_1, . . . , 160_N−1. According to embodiments, the reference voltage VREF may be, but not be limited to, an analog power supply voltage AVDD that is supplied to an analog circuit of a data driver included in a display device, or an analog voltage generated by a dedicated DAC circuit different from the DAC circuit 160_1, . . . , 160_N−1. The analog power supply voltage AVDD or the analog voltage generated by the dedicated DAC circuit may have a ripple. In some embodiments, as illustrated in FIG. 1, each input circuit 140_1, . . . , 140_N−1 may include an input buffer 142 that receives the reference voltage VREF, and that outputs the reference voltage VREF as it is. Further, in some embodiments, the input buffer 142 may receive, as a power supply voltage, a logic voltage VL that is supplied to a logic circuit of a power management integrated circuit (PMIC). However, the power supply voltage of the input buffer 142 is not limited to the logic voltage VL.

The DAC circuit 160_1, . . . , 160_N−1 of each of the first through (N−1)-th gamma generation circuits 120_1, . . . , 120_N−1 may generate an analog voltage corresponding to a gamma code GCODE1, . . . , GCODEN−1 received from a controller included in the display device based on the reference voltage VREF received from the input circuit 140_1, . . . , 140_N−1. For example, the DAC circuit 160_1 of the first gamma generation circuit 120_1 may generate an analog voltage corresponding to a first gamma code GCODE1 based on the reference voltage VREF received from the input circuit 140_1, and the DAC circuit 160_N−1 of the (N−1)-th gamma generation circuit 120_N−1 may generate an analog voltage corresponding to an (N−1)-th gamma code GCODEN−1 based on the reference voltage VREF received from the input circuit 140_N−1. In some embodiments, as illustrated in FIG. 1, each DAC circuit 160_1, . . . , 160_N−1 may include a resistor string 162 that generates a plurality of analog voltages by dividing the reference voltage VREF (or a voltage between the reference voltage VREF and a ground voltage) received from each input circuit 140_1, . . . , 140N−1 and an analog voltage select circuit 164 configured to select an analog voltage corresponding to each gamma code GCODE1, . . . , GCODEN−1 among the plurality of analog voltages in response to each gamma code GCODE1, . . . , GCODEN−1.

Each output circuit 180_1, . . . , 180_N−1 of the first through (N−1)-th gamma generation circuits 120_1, . . . , 120_N−1 may output a gamma voltage VGMA1, . . . , VGMAN−1 based on the analog voltage received from the DAC circuit 160_1, . . . , 160_N−1. Each output circuit 180_1, . . . , 180_N−1 may include an output buffer 182 that receives the analog voltage from the DAC circuit 160_1, . . . , 160_N−1, and that outputs the gamma voltage VGMA1, . . . , VGMA_N−1. In some embodiments, the output buffer 182 may receive, as a power supply voltage, an input voltage VIN provided from an external device (e.g., a host), or the analog power supply voltage AVDD that is supplied to the analog circuit of the data driver. However, the power supply voltage of the output buffer 182 is not limited to the input voltage VIN and the analog power supply voltage AVDD.

Figure 5:
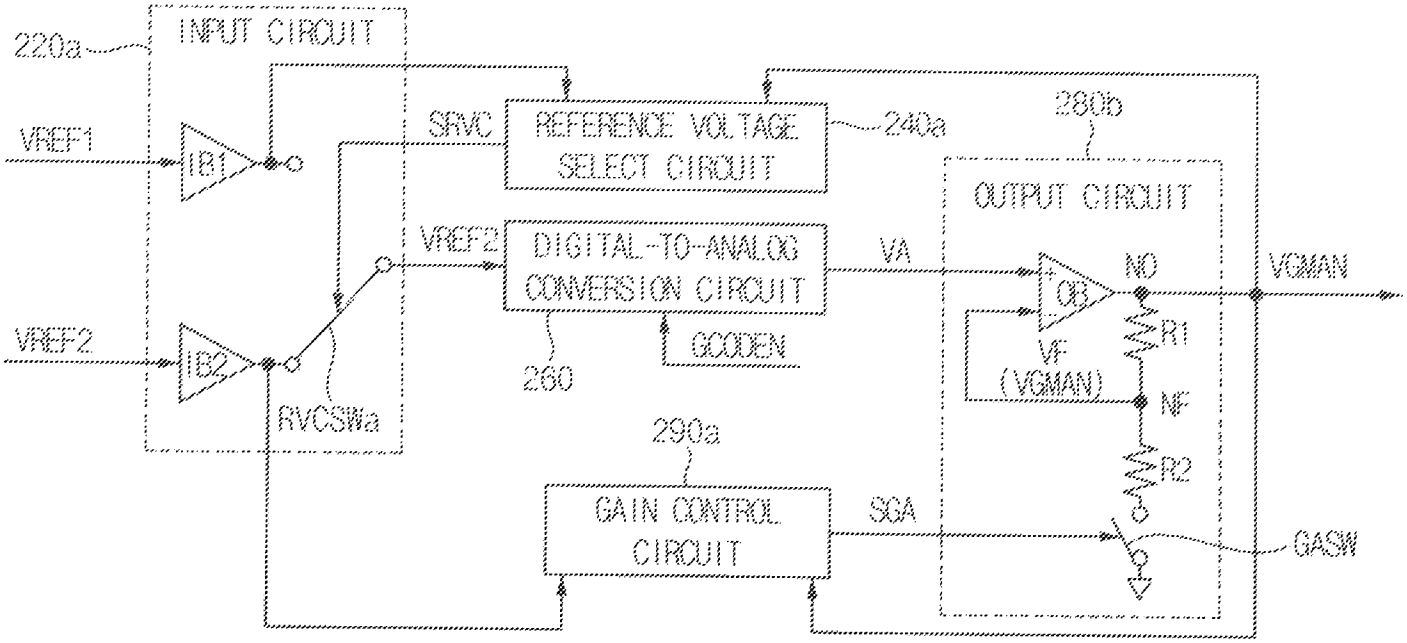
FIG. 5 is a diagram for describing an example of an operation of a gamma generation circuit illustrated in FIG. 2 in a case where a gamma voltage is greater than a first reference voltage and is less than or equal to a second reference voltage.

In some embodiments, each output circuit 180_1, . . . , 180_N−1 may generate the gamma voltage VGMA1, . . . , VGMA_N−1 by multiplying the analog voltage received from the DAC circuit 160_1, . . . , 160_N−1 by a predetermined gain (e.g., a gain of 5 in an example of FIG. 5). For example, each output circuit 180_1, . . . , 180_N−1 may include an output buffer 182 that includes a first input terminal (e.g., a positive input terminal) for receiving the analog voltage from the DAC circuit 160_1, . . . , 160_N−1, a second input terminal (e.g., a negative input terminal) for receiving a feedback voltage, and an output terminal for outputting the gamma voltage VGMA1, . . . , VGMAN−1 and a voltage divider 4R and R that generate the feedback voltage by dividing the gamma voltage VGMA1, . . . , VGMAN−1. As illustrated in FIG. 1, in a case where the voltage divider 4R and R includes a first resistor having a resistance value of "4R" and a second resistor having a resistance value of "R", the voltage divider 4R and R may generate the feedback voltage corresponding to one-fifth of the gamma voltage VGMA1, . . . , VGMAN−1. In this case, the output buffer 182 may generate the gamma voltage VGMA1, . . . , VGMAN−1 by amplifying the analog voltage with the gain of 5 such that the feedback voltage at the second input terminal becomes the analog voltage at the first input terminal. Although FIG. 1 illustrates an example where the output circuit 180_1 of the first gamma generation circuit 120_1 has the gain of 5, a gain of the output circuit 180_1, . . . , 180_N−1 of each of the first through (N−1)-th gamma generation circuits 120_1, . . . , 120_N−1 is not limited to the example of FIG. 1. Further, according to embodiments, the output circuits 180_1, . . . , 180_N−1 of the first through (N−1)-th gamma generation circuits 120_1, . . . , 120_N−1 may have substantially the same gain, or may have different gains.

In other embodiments, the output circuit 180_1, . . . , 180_N−1 of each of the first through (N−1)-th gamma generation circuits 120_1, . . . , 120_N−1 may have no gain (or may have a gain of 1), and may output, as the gamma voltage VGMA1, . . . , VGMAN−1, the analog voltage received from the DAC circuit 160_1, . . . , 160_N−1. In this case, each output circuit 180_1, . . . , 180_N−1 may include only the output buffer 182 without the voltage divider 4R and R.

In some embodiments, an output terminal of the output circuit 180_1, . . . , 180_N−1 of each of the first through (N−1)-th gamma generation circuits 120_1, . . . , 120_N−1 may be coupled to an output capacitor OC1, . . . , OCN−1. The output capacitor OC1, . . . , OCN−1 may be used to stabilize the gamma voltage VGMA1, . . . , VGMAN−1 output at the output terminal. In some embodiments, the output capacitor OC1, . . . , OCN−1 may be located outside the gamma voltage generator 100*a* or outside the PMIC including the gamma voltage generator 100*a*. However, a location of the output capacitor OC1, . . . , OCN−1 is not limited thereto.

Although FIG. 1 illustrates an example where each of the first through (N−1)-th gamma generation circuits 120_1, . . . , 120_N−1 generates the gamma voltage VGMA1, . . . , VGMAN−1 by using one fixed reference voltage VREF, in other embodiments, each of the first through (N−1)-th gamma generation circuits 120_1, . . . , 120_N−1 may generate the gamma voltage VGMA1, . . . , VGMAN−1 by using two or more fixed reference voltages.

The N-th gamma generation circuit 200*a* may include an input circuit 220*a*, a reference voltage select circuit 240*a*, a DAC circuit 260 and an output circuit 280*a*. Unlike each of the first through (N−1)-th gamma generation circuits 120_1, . . . , 120_N−1, the N-th gamma generation circuit 200*a* may receive two or more reference voltages VREF1 and VREF2, and may further include the reference voltage select circuit 240*a* that selects one of the two or more reference voltages VREF1 and VREF2.

The input circuit 220*a* may receive a first reference voltage VREF1, and a second reference voltage VREF2 higher than the first reference voltage VREF1, and may provide a reference voltage selected by the reference voltage select circuit 240*a* among the first reference voltage VREF1 and the second reference voltage VREF2 to the DAC circuit 260. Compared with the analog power supply voltage AVDD or the analog voltage generated by the dedicated DAC circuit that may be used as the reference voltage VREF for the first through (N−1)-th gamma generation circuits 120_1, . . . , 120_N−1, the first reference voltage VREF1 and the second reference voltage VREF2 may have a relatively small ripple. In some embodiments, the first reference voltage VREF1 may be, but not be limited to, a band gap reference (BGR) voltage VBGR that is generated by a BGR circuit, and the second reference voltage VREF2 may be, but not be limited to, the logic voltage VL that is higher than the BGR voltage VBGR and that is supplied to the logic circuit of the PMIC.

In some embodiments, the input circuit 220*a* may selectively output the first reference voltage VREF1 or the second reference voltage VREF2 in response to a reference voltage control signal SRVC received from the reference voltage select circuit 240*a*. For example, as illustrated in FIG. 1, the input circuit 220*a* may include a first input buffer IB1 that receives the first reference voltage VREF1 through an input terminal and that outputs the first reference voltage VREF1 through an output terminal, a second input buffer IB2 that receives the second reference voltage VREF2 through an input terminal and that outputs the second reference voltage VREF2 through an output terminal, and a reference voltage control switch RVCSWa that selectively couples the output terminal of the first input buffer IB1 or the output terminal of the second input buffer IB2 to the DAC circuit 260 in response to the reference voltage control signal SRVC. In some embodiments, each of the first and second input buffers IB1 and IB2 may receive, as a power supply voltage, the logic voltage VL that is supplied to the logic circuit of the PMIC. However, the power supply voltage of the first and second input buffers IB1 and IB2 is not limited to the logic voltage VL.

The reference voltage select circuit 240*a* may select one reference voltage among the first reference voltage VREF1 and the second reference voltage VREF2 by comparing the gamma voltage VGMAN with at least one of the first reference voltage VREF1 and the second reference voltage VREF2. In some embodiments, in a case where the second reference voltage VREF2 is higher than the first reference voltage VREF1, the reference voltage select circuit 240*a* may select one of the first and second reference voltages VREF1 and VREF2 by comparing the gamma voltage VGMAN with the first reference voltage VREF1. The reference voltage select circuit 240*a* may select the first reference voltage VREF1 among the first reference voltage VREF1 and the second reference voltage VREF2 in a case where the gamma voltage VGMAN is less than or equal to the first reference voltage VREF1, and may select the second reference voltage VREF2 among the first reference voltage VREF1 and the second reference voltage VREF2 in a case where the gamma voltage VGMAN is greater than the first reference voltage VREF1. For example, in the case where the gamma voltage VGMAN is less than or equal to the first reference voltage VREF1, the reference voltage select circuit 240*a* may generate the reference voltage control signal SRVC having a first level, the reference voltage control switch RVCSWa may couple the first input buffer IB1 to the DAC circuit 260 in response to the reference voltage control signal SRVC having the first level, and the DAC circuit 260 may receive the first reference voltage VREF1 from the first input buffer IB1. Further, in the case where the gamma voltage VGMAN is greater than the first reference voltage VREF1, the reference voltage select circuit 240*a* may generate the reference voltage control signal SRVC having a second level, the reference voltage control switch RVCSWa may couple the second input buffer IB2 to the DAC circuit 260 in response to the reference voltage control signal SRVC having the second level, and the DAC circuit 260 may receive the second reference voltage VREF2 from the second input buffer IB2.

In some embodiments, to compare the gamma voltage VGMAN with at least one of the first reference voltage VREF1 and the second reference voltage VREF2, the reference voltage select circuit 240*a* may receive a gamma code GCODEN corresponding to the gamma voltage VGMAN from the controller. For example, the reference voltage select circuit 240*a* may previously store a code value corresponding to the first reference voltage VREF1, and may compare the gamma voltage VGMAN with the first reference voltage VREF1 by comparing the gamma code GCODEN with the stored code. In other embodiments, the reference voltage select circuit 240*a* may receive a select value corresponding to a result of a comparison between the gamma voltage VGMAN and the first reference voltage VREF1 from the controller, and may include a register for storing the select value. In this case, the reference voltage select circuit 240*a* may generate the reference voltage control signal SRVC based on the select value stored in the register.

The DAC circuit 260 may receive the reference voltage selected by the reference voltage select circuit 240*a* from the input circuit 220*a*, and may generate an analog voltage VA corresponding to the gamma code GCODEN received from the controller based on the selected reference voltage. In some embodiments, as illustrated in FIG. 1, the DAC circuit 260 may include a resistor string 262 that generates a plurality of analog voltages PVA by dividing the selected reference voltage (or a voltage between the selected reference voltage and the ground voltage) received from the input circuit 220*a*, and an analog voltage select circuit 264 that selects the analog voltage VA corresponding to the gamma code GCODEN among the plurality of analog voltages PVA in response to the gamma code GCODEN.

The output circuit 280*a* may output the gamma voltage VGMAN based on the analog voltage VA received from the DAC circuit 260. In some embodiments, as illustrated in FIG. 1, the output circuit 280*a* may include an output buffer OB that receives the analog voltage VA from the DAC circuit 260 and that outputs the analog voltage VA as the gamma voltage VGMAN. Thus, the output circuit 280*a* may have no gain (or may have a gain of 1), and may output the analog voltage VA as it is. In some embodiments, the output buffer OB may receive, as a power supply voltage, the input voltage VIN provided from the external device (e.g., the host), or the analog power supply voltage AVDD that is supplied to the analog circuit of the data driver. However, the power supply voltage of the output buffer OB is not limited to the input voltage VIN and the analog power supply voltage AVDD.

In some embodiments, an output terminal of the output circuit 280*a* may be coupled to an output capacitor OCN. The output capacitor OCN may be used to stabilize the gamma voltage VGMAN output at the output terminal. In some embodiments, the output capacitor OCN may be located outside the gamma voltage generator 100*a* or outside the PMIC, but a location of the output capacitor OCN is not limited thereto.

Although FIG. 1 illustrates an example where the N-th gamma generation circuit 200*a* generates the gamma voltage VGMAN by using the reference voltage selected among the first reference voltage VREF1 and the second reference voltage VREF2, in other embodiments, the N-th gamma generation circuit 200*a* may select the reference voltage among three or more reference voltages.

In a conventional gamma voltage generator, each of all gamma generation circuits may receive a fixed reference voltage, and may generate a gamma voltage by using the fixed reference voltage. Further, the conventional gamma voltage generator may use, as the fixed reference voltage, an analog power supply voltage provided to an analog circuit of a data driver or an analog voltage generated by a dedicated DAC circuit, and the analog power supply voltage or the analog voltage generated by the dedicated DAC circuit may have a ripple or may fluctuate. Thus, in the conventional gamma voltage generator, the reference voltage may have the ripple or may fluctuate, gamma voltages generated based on the reference voltage also may have a ripple or may fluctuate, data voltages generated based on the gamma voltages may have a ripple or may fluctuate, and thus a flicker may occur in an image displayed based on the data voltages. In particular, in a case where a conventional display device including the conventional gamma voltage generator display a low gray image based on the lowest gamma voltage among the gamma voltages, the flicker of the conventional display device may be intensified.

However, in the gamma voltage generator 100*a* according to embodiments, at least one gamma generation circuit 200*a* that generates at least one gamma voltage VGMAN (e.g., the lowest gamma voltage VGMAN) may receive the first and second reference voltages VREF1 and VREF2 (e.g., the BGR voltage VBGR and the logic voltage VL) having a relatively small ripple or a relatively small fluctuation compared with the reference voltage (e.g., the analog power supply voltage or the analog voltage generated by the dedicated DAC circuit) of the conventional gamma voltage generator. Accordingly, compared with the gamma voltage generated by the conventional gamma voltage generator, the gamma voltage VGMAN generated by the gamma generation circuit 200*a* may have a relatively small ripple or a relatively small fluctuation. Further, the gamma generation circuit 200*a* may select one of the first and second reference voltages VREF1 and VREF2 by comparing the gamma voltage VGMAN with at least one of the first and second reference voltages VREF1 and VREF2, and may generate the gamma voltage VGMAN by using the selected reference voltage. Thus, the gamma generation circuit 200*a* may generate the gamma voltage VGMAN by using an optimal reference voltage that is close to the gamma voltage VGMAN (in some embodiments, while the optimal reference voltage may be higher than or equal to the gamma voltage VGMAN). Accordingly, the ripple or the fluctuation of the gamma voltage VGMAN may be further reduced, a ripple or a fluctuation of data voltages generated based on the gamma voltage VGMAN may be reduced, and the flicker in the low gray image of a display device including the gamma voltage generator 100*a* may be reduced.

Figure 2:
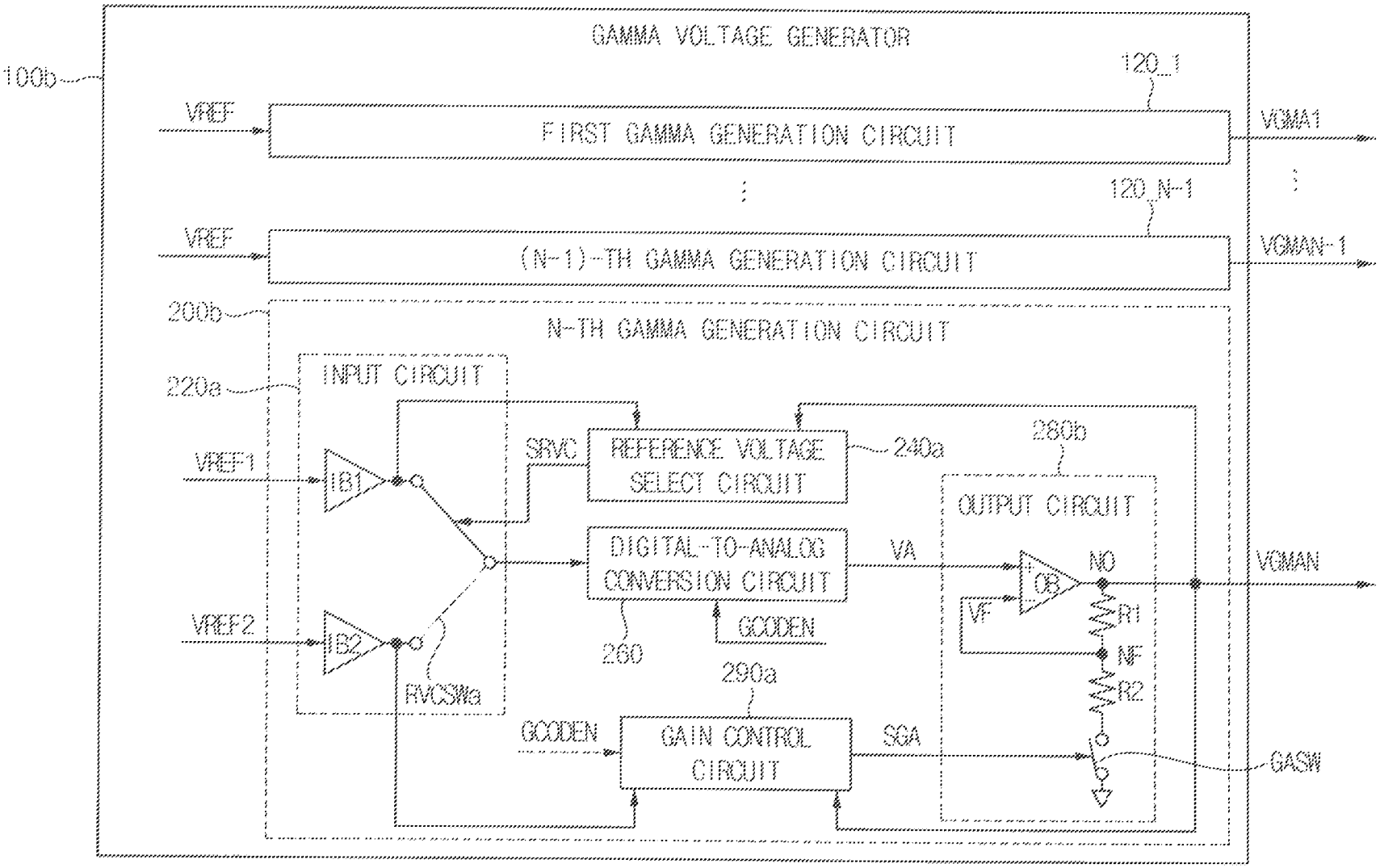
FIG. 2 is a block diagram illustrating a gamma voltage generator according to embodiments.

FIG. 2 is a block diagram illustrating a gamma voltage generator according to embodiments.

Referring to FIG. 2, a gamma voltage generator 100*b* according to embodiments may include first through N-th gamma generation circuits 120_1, . . . , 120_N−1 and 200*b* that respectively generate first through N-th gamma voltages VGMA1, . . . , VGMAN−1 and VGMAN. Each of the first through (N−1)-th gamma generation circuits 120_1, . . . , 120_N−1 may generate the gamma voltage VGMA1, . . . , VGMAN−1 by using one reference voltage VREF, and the N-th gamma generation circuit 200*b* that generates the N-th gamma voltage VGMAN (e.g., the lowest gamma voltage VGMAN) among the first through N-th gamma voltages VGMA1, . . . , VGMAN−1 and VGMAN may generate the N-th gamma voltage VGMAN by selectively using a first reference voltage VREF1 or a second reference voltage VREF2. The N-th gamma generation circuit 200*b* may include an input circuit 220*a*, a reference voltage select circuit 240*a*, a digital-to-analog conversion circuit (DAC circuit) 260, an output circuit 280*b* and a gain control circuit 290*a*. The gamma voltage generator 100*b* of FIG. 2 may have a similar configuration and a similar operation to a gamma voltage generator 100*a* of FIG. 1 except that a gain of the output circuit 280*b* may be selectively applied by the gain control circuit 290*a*.

The input circuit 220*a* may receive the first reference voltage VREF1 and the second reference voltage VREF2, and the reference voltage select circuit 240*a* may select one of the first reference voltage VREF1 and the second reference voltage VREF2 by comparing the N-th gamma voltage VGMAN with the first reference voltage VREF1 that is a lower one of the first and second reference voltages VREF1 and VREF2. The input circuit 220*a* may provide a reference voltage selected by the reference voltage select circuit 240*a* among the first reference voltage VREF1 and the second reference voltage VREF2 to the DAC circuit 260, and the DAC circuit 260 may generate an analog voltage VA corresponding to a gamma code GCODEN based on the selected reference voltage.

The output circuit 280*b* may output the N-th gamma voltage VGMAN based on the analog voltage VA received from the DAC circuit 260. The output circuit 280*b* may be controlled by the gain control circuit 290*a* to output the analog voltage VA as the N-th gamma voltage VGMAN without applying the gain of the output circuit 280*b* or to generate the N-th gamma voltage VGMAN by applying the gain of the output circuit 280*b* to the analog voltage VA. Here, the gain of the output circuit 280*b* may be a ratio of the N-th gamma voltage VGMAN that is an output voltage of the output circuit 280*b* to the analog voltage VA that is an input voltage of the output circuit 280*b*. Further, when the gain of the output circuit 280*b* is not applied, the output circuit 280*b* outputs the N-th gamma voltage VGMAN substantially the same as the analog voltage VA received from the DAC circuit 260, that is, the gain of the output circuit 280*b* equals to 1. Further, when the gain of the output circuit 280*b* is applied, the output circuit 280*b* generates the N-th gamma voltage VGMAN by multiplying the analog voltage VA by the gain of the output circuit 280*b* which is different from 1. For example, in a case where the gain of the output circuit 280*b* is greater than 1, the N-th gamma voltage VGMAN that is the output voltage of the output circuit 280*b* may be higher than the analog voltage VA that is the input voltage of the output circuit 280*b*.

In some embodiments, as illustrated in FIG. 2, the output circuit 280*b* may include an output buffer OB, a first resistor R1, a second resistor R2 and a gain application switch GASW. The output buffer OB may include a first input terminal (e.g., a positive input terminal) for receiving the analog voltage VA, a second input terminal (e.g., a negative input terminal) coupled to a feedback node NF, and an output terminal coupled to an output node NO at which the N-th gamma voltage VGMAN is output. The first resistor R1 may include a first terminal coupled to the output node NO and a second terminal coupled to the feedback node NF. The second resistor R2 may include a first terminal coupled to the feedback node NF and a second terminal. The gain application switch GASW may selectively couple the second terminal of the second resistor R2 to a power supply voltage line (e.g., a low power supply voltage line or a ground voltage line) in response to a gain application signal SGA output from the gain control circuit 290*a*. In a case where the gain application switch GASW is turned off, or in a case where the second terminal of the second resistor R2 is decoupled from the power supply voltage line, the output buffer OB may receive the N-th gamma voltage VGMAN as a feedback voltage VF at the second input terminal, and may output the analog voltage VA as the N-th gamma voltage VGMAN. Alternatively, in a case where the gain application switch GASW is turned on, or in a case where the second terminal of the second resistor R2 is coupled to the power supply voltage line, a voltage divider including the first resistor R1 and the second resistor R2 may generate the feedback voltage VF by dividing the N-th gamma voltage VGMAN. For example, in a case where the first resistor R1 and the second resistor R2 have the same resistance value, the voltage divider may generate the feedback voltage VF corresponding to a half of the N-th gamma voltage VGMAN. In this case, the output buffer OB may receive the feedback voltage VF corresponding to the half of the N-th gamma voltage VGMAN at the second input terminal, and may generate the N-th gamma voltage VGMAN by multiplying the analog voltage VA by a gain of 2 such that the feedback voltage VF at the second input terminal may become the analog voltage VA at the first input terminal.

The gain control circuit 290*a* may compare the N-th gamma voltage VGMAN with the second reference voltage VREF2 that is a higher one of the first and second reference voltages VREF1 and VREF2. In some embodiments, to compare the N-th gamma voltage VGMAN with the second reference voltage VREF2, the gain control circuit 290*a* may receive the gamma code GCODEN corresponding to the N-th gamma voltage VGMAN. For example, the gain control circuit 290*a* may previously store a code value corresponding to the second reference voltage VREF2, and may compare the N-th gamma voltage VGMAN with the second reference voltage VREF2 by comparing the gamma code GCODEN with the stored code. In other embodiments, the gain control circuit 290*a* may receive a select value corresponding to a result of a comparison between the N-th gamma voltage VGMAN and the second reference voltage VREF2 from a controller, and may include a register for storing the select value. In this case, the gain control circuit 290*a* may generate the gain application signal SGA based on the select value stored in the register.

Further, the gain control circuit 290*a* may control the output circuit 280*b* such that the gain of the output circuit 280*b* may be selectively applied according to a result of a comparison between the N-th gamma voltage VGMAN and the second reference voltage VREF2. In some embodiments, the gain control circuit 290*a* may control the output circuit 280*b* to output the analog voltage VA as the N-th gamma voltage VGMAN without applying the gain of the output circuit 280*b* in a case where the N-th gamma voltage VGMAN is less than or equal to the second reference voltage VREF2, and may control the output circuit 280*b* to generate the N-th gamma voltage VGMAN by multiplying the analog voltage VA by the gain of the output circuit 280*b* in a case where the N-th gamma voltage VGMAN is greater than the second reference voltage VREF2. For example, in a case where the N-th gamma voltage VGMAN is less than or equal to the second reference voltage VREF2, the gain control circuit 290*a* may generate the gain application signal SGA having a first level, the gain application switch GASW may decouple the second terminal of the second resistor R2 from the power supply voltage line in response to the gain application signal SGA having the first level, and the output buffer OB may output the analog voltage VA as the N-th gamma voltage VGMAN without applying the gain of the output circuit 280*b*. Alternatively, in a case where the N-th gamma voltage VGMAN is greater than the second reference voltage VREF2, the gain control circuit 290*a* may generate the gain application signal SGA having a second level, the gain application switch GASW may couple the second terminal of the second resistor R2 to the power supply voltage line in response to the gain application signal SGA having the second level, and the output buffer OB may generate the N-th gamma voltage VGMAN by amplifying the analog voltage VA with the gain of the output circuit 280*b*.

Accordingly, in the gamma voltage generator 100*b* according to embodiments, in a case where the N-th gamma voltage VGMAN is less than or equal to the first reference voltage VREF1, the N-th gamma generation circuit 200*b* may not apply the gain of the output circuit 280*b*, and may generate the N-th gamma voltage VGMAN by using the first reference voltage VREF1. Further, in a case where the N-th gamma voltage VGMAN is greater than the first reference voltage VREF1 and less than or equal to the second reference voltage VREF2, the N-th gamma generation circuit 200*b* may not apply the gain of the output circuit 280*b*, and may generate the N-th gamma voltage VGMAN by using the second reference voltage VREF2. Further, in a case where the N-th gamma voltage VGMAN is greater than the second reference voltage VREF2, the N-th gamma generation circuit 200*b* may apply the gain of the output circuit 280*b*, and may generate the N-th gamma voltage VGMAN by using the second reference voltage VREF2. As described above, the N-th gamma generation circuit 200*b* may generate the N-th gamma voltage VGMAN by selectively applying the gain of the output circuit 280*b* and by using an optimal reference voltage among the first and second reference voltages VREF1 and VREF2. Accordingly, a ripple or a fluctuation of the N-th gamma voltage VGMAN may be reduced, a ripple or a fluctuation of data voltages generated based on the N-th gamma voltage VGMAN may be reduced, and thus a flicker of a display device including the gamma voltage generator 100*b* may be reduced.

Figure 3:
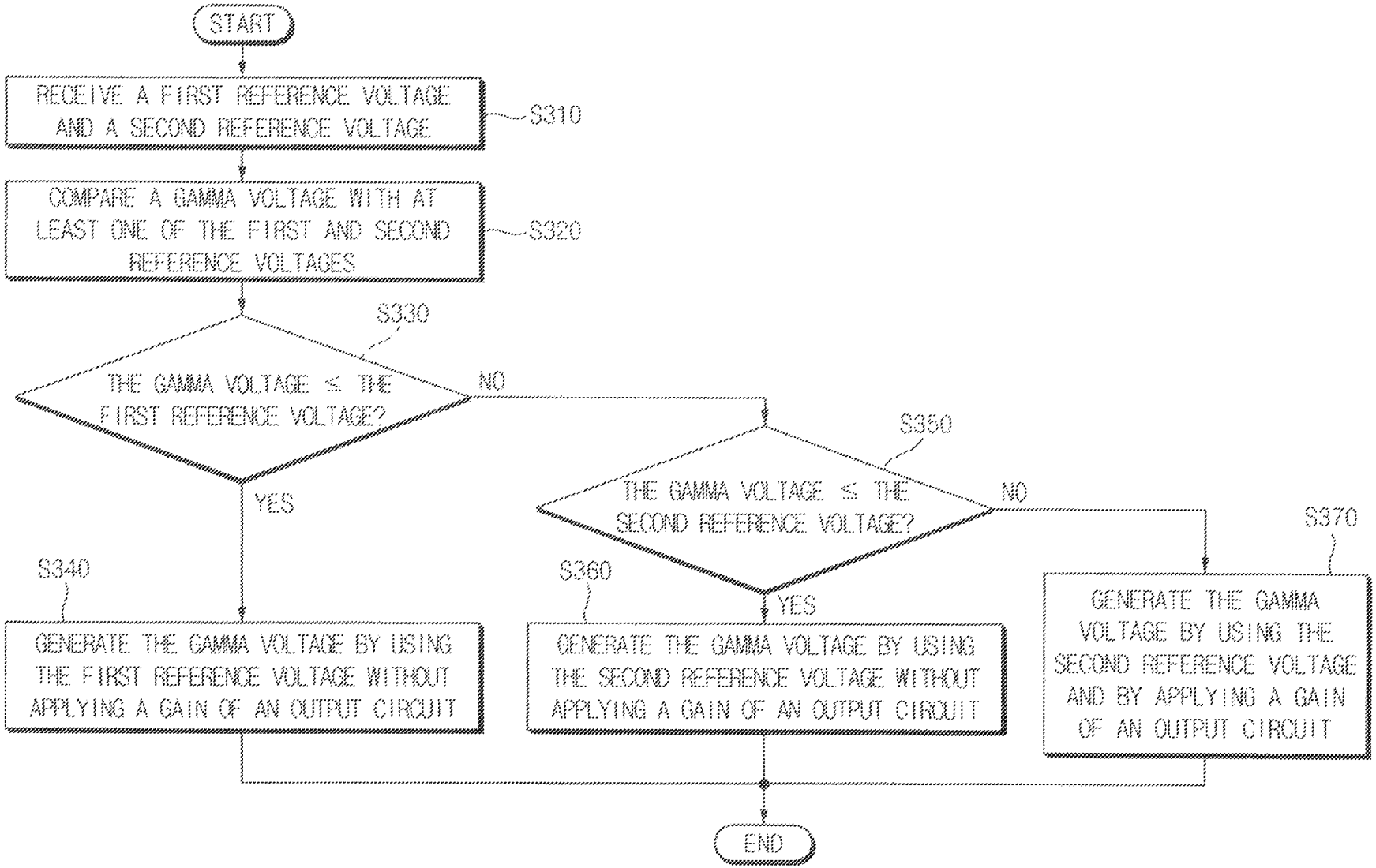
FIG. 3 is a flowchart illustrating a method of generating a gamma voltage by a gamma generation circuit included in a gamma voltage generator according to embodiments.
Figure 4:
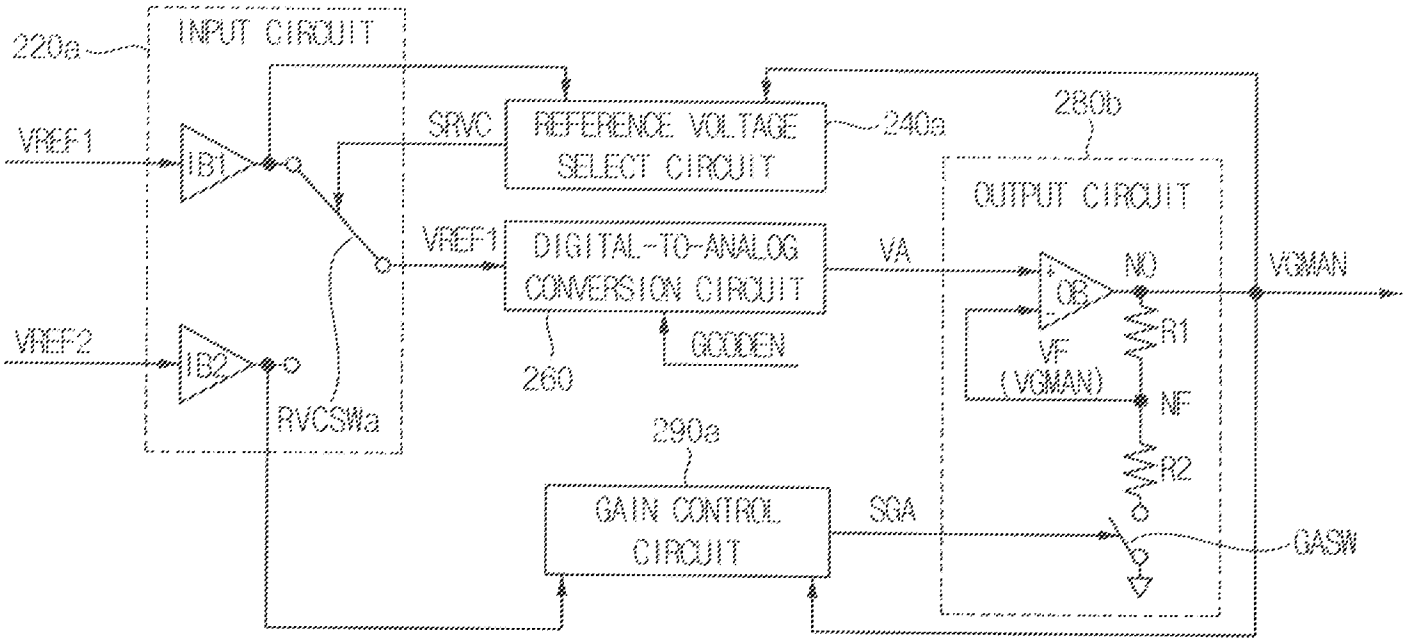
FIG. 4 is a diagram for describing an example of an operation of a gamma generation circuit illustrated in FIG. 2 in a case where a gamma voltage is less than or equal to a first reference voltage.
Figure 6:
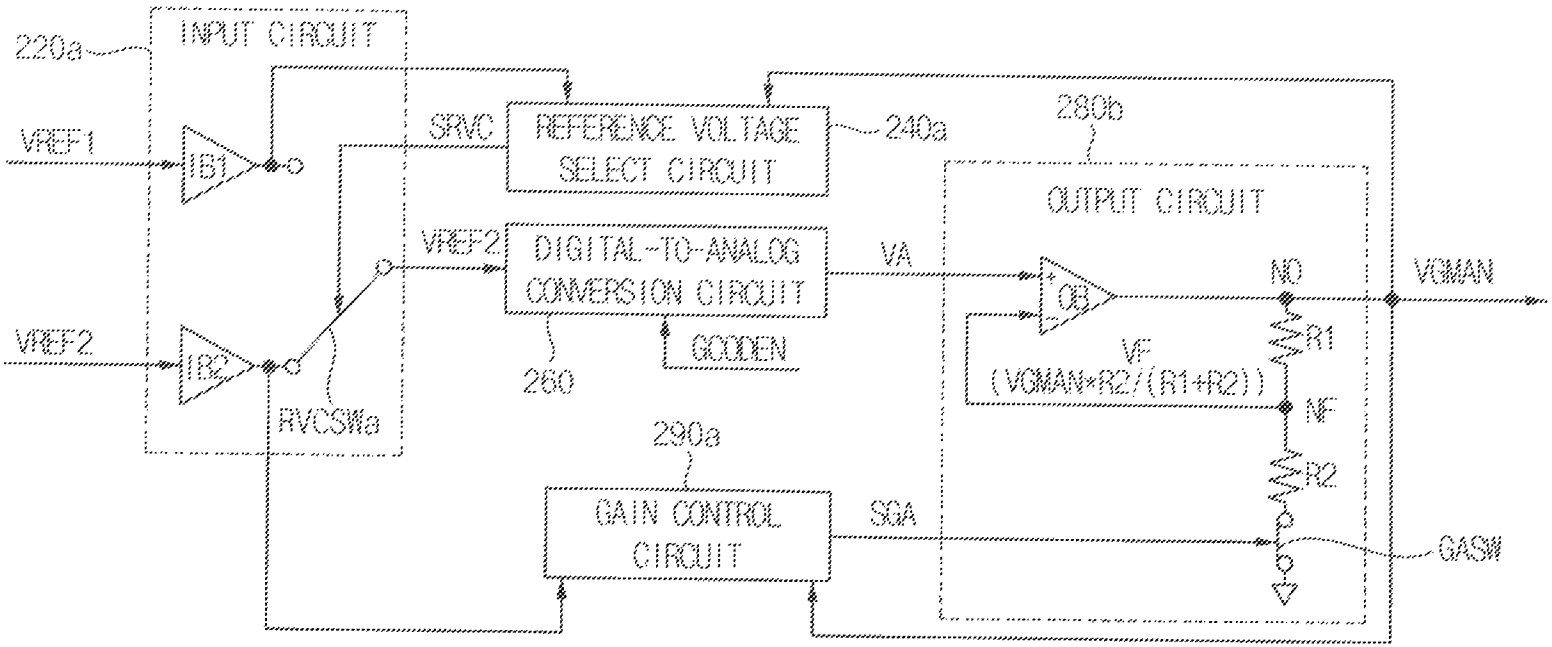
FIG. 6 is a diagram for describing an example of an operation of a gamma generation circuit illustrated in FIG. 2 in a case where a gamma voltage is greater than a second reference voltage.

FIG. 3 is a flowchart illustrating a method of generating a gamma voltage by a gamma generation circuit included in a gamma voltage generator according to embodiments, FIG. 4 is a diagram for describing an example of an operation of a gamma generation circuit illustrated in FIG. 2 in a case where a gamma voltage is less than or equal to a first reference voltage, FIG. 5 is a diagram for describing an example of an operation of a gamma generation circuit illustrated in FIG. 2 in a case where a gamma voltage is greater than a first reference voltage and is less than or equal to a second reference voltage, and FIG. 6 is a diagram for describing an example of an operation of a gamma generation circuit illustrated in FIG. 2 in a case where a gamma voltage is greater than a second reference voltage.

Referring to FIGS. 2 and 3, a gamma generation circuit 200*b* may receive a first reference voltage VREF1 and a second reference voltage VREF2 (S310). In some embodiments, the first reference voltage VREF1 and the second reference voltage VREF2 may be constant voltages having a small ripple or a small fluctuation.

The gamma generation circuit 200*b* may compare a gamma voltage VGMAN with at least one of the first reference voltage VREF1 and the second reference voltage VREF2 (S320). In some embodiments, a reference voltage select circuit 240*a* may compare the gamma voltage VGMAN with the first reference voltage VREF1 that is a lower one of the first and second reference voltages VREF1 and VREF2, and a gain control circuit 290*a* may compare the gamma voltage VGMAN with the second reference voltage VREF2 that is a higher one of the first and second reference voltages VREF1 and VREF2.

In a case where the gamma voltage VGMAN is less than or equal to the first reference voltage VREF1 (S330: YES), the gamma generation circuit 200*b* may generate the gamma voltage VGMAN by using the first reference voltage VREF1 without applying a gain of an output circuit 280*b* (S340). For example, as illustrated in FIG. 4, the reference voltage select circuit 240*a* may generate a reference voltage control signal SRVC for selecting the first reference voltage VREF1, a reference voltage control switch RVCSWa may couple a first input buffer IB1 to a DAC circuit 260 in response to the reference voltage control signal SRVC, and an input circuit 220*a* may provide the first reference voltage VREF1 output from the first input buffer IB1 to the DAC circuit 260. The DAC circuit 260 may generate an analog voltage VA corresponding to a gamma code GCODEN based on the first reference voltage VREF1. The gain control circuit 290*a* may generate a gain application signal SGA for turning off a gain application switch GASW, the gain application switch GASW may decouple a second resistor R2 from a power supply voltage line in response to the gain application signal SGA, an output buffer OB may receive the gamma voltage VGMAN as a feedback voltage VF, and the output circuit 280*b* may output the analog voltage VA as the gamma voltage VGMAN without applying the gain of the output circuit 280*b*.

Further, in a case where the gamma voltage VGMAN is greater than the first reference voltage VREF1 and less than or equal to the second reference voltage VREF2 (S330: NO and S350: YES), the gamma generation circuit 200*b* may generate the gamma voltage VGMAN by using the second reference voltage VREF2 without applying the gain of the output circuit 280*b* (S360). For example, as illustrated in FIG. 5, the reference voltage select circuit 240*a* may generate the reference voltage control signal SRVC for selecting the second reference voltage VREF2, the reference voltage control switch RVCSWa may couple a second input buffer IB2 to the DAC circuit 260 in response to the reference voltage control signal SRVC, and the input circuit 220*a* may provide the second reference voltage VREF2 output from the second input buffer IB2 to the DAC circuit 260. The DAC circuit 260 may generate the analog voltage VA corresponding to the gamma code GCODEN based on the second reference voltage VREF2. The gain control circuit 290*a* may generate the gain application signal SGA for turning off the gain application switch GASW, the gain application switch GASW may decouple the second resistor R2 from the power supply voltage line in response to the gain application signal SGA, the output buffer OB may receive the gamma voltage VGMAN as the feedback voltage VF, and the output circuit 280*b* may output the analog voltage VA as the gamma voltage VGMAN without applying the gain of the output circuit 280*b*.

Further, in a case where the gamma voltage VGMAN is greater than the second reference voltage VREF2 (S330: NO and S350: NO), the gamma generation circuit 200*b* may generate the gamma voltage VGMAN by using the second reference voltage VREF2 and by applying the gain of the output circuit 280*b* (S370). For example, as illustrated in FIG. 6, the reference voltage select circuit 240*a* may generate the reference voltage control signal SRVC for selecting the second reference voltage VREF2, the reference voltage control switch RVCSWa may couple the second input buffer IB2 to the DAC circuit 260 in response to the reference voltage control signal SRVC, and the input circuit 220*a* may provide the second reference voltage VREF2 output from the second input buffer IB2 to the DAC circuit 260. The DAC circuit 260 may generate the analog voltage VA corresponding to the gamma code GCODEN based on the second reference voltage VREF2. The gain control circuit 290*a* may generate the gain application signal SGA for turning on the gain application switch GASW, the gain application switch GASW may couple the second resistor R2 to the power supply voltage line in response to the gain application signal SGA, the output buffer OB may receive the feedback voltage VF corresponding to VGMAN*R2/(R1+R2), and the output circuit 280*b* may generate the gamma voltage VGMAN by multiplying the analog voltage VA by the gain of the output circuit 280*b*, or a gain of "(R1+R2)/R2".

As described above, in a method of generating the gamma voltage VGMAN by the gamma generation circuit 200*b* according to embodiments, the gain of the output circuit 280*b* may be selectively applied, and the gamma voltage VGMAN may be generated by using an optimal reference voltage among the first and second reference voltages VREF1 and VREF2. Accordingly, a ripple or a fluctuation of the gamma voltage VGMAN may be reduced, a ripple or a fluctuation of data voltages may be reduced, and thus a flicker of a display device may be reduced.

Figure 7:
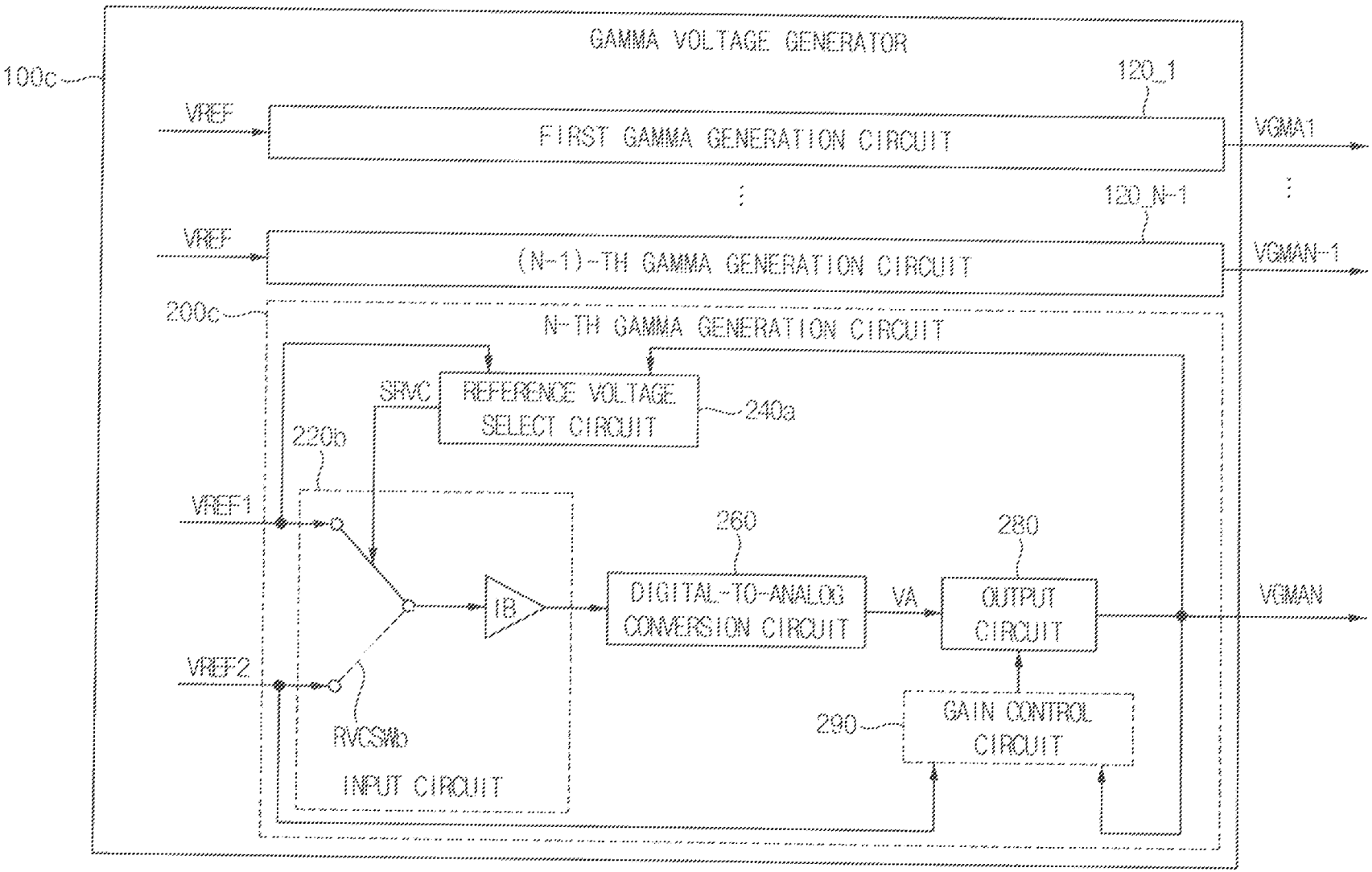
FIG. 7 is a block diagram illustrating a gamma voltage generator according to embodiments.

FIG. 7 is a block diagram illustrating a gamma voltage generator according to embodiments.

Referring to FIG. 7, a gamma voltage generator 100*c* according to embodiments may include a plurality of gamma generation circuits 120_1, . . . , 120_N−1 and 200*c* that respectively generate a plurality of gamma voltages VGMA1, . . . , VGMAN−1 and VGMAN. At least one gamma generation circuit 200*c* of the plurality of gamma generation circuits 120_1, . . . , 120_N−1 and 200*c* may include an input circuit 220*b*, a reference voltage select circuit 240*a*, a DAC circuit 260 and an output circuit 280*b*. In some embodiments, the gamma generation circuit 200*c* may further include a gain control circuit 290. The gamma voltage generator 100*c* of FIG. 7 may have a similar configuration and a similar operation to a gamma voltage generator 100*a* of FIG. 1 or a gamma voltage generator 100*b* of FIG. 2, except that the input circuit 220*b* of the gamma generation circuit 200*c* may include one input buffer IB.

The input circuit 220*b* may receive a first reference voltage VREF1 and a second reference voltage VREF2, and may selectively provide the first reference voltage VREF1 or the second reference voltage VREF2 to the DAC circuit 260 in response to a reference voltage control signal SRVC of the reference voltage select circuit 240*a*. In some embodiments, as illustrated in FIG. 7, the input circuit 220*b* may include an input buffer IB and a reference voltage select switch RVCSWb. The input buffer IB may include an input terminal, and an output terminal coupled to the DAC circuit 260. The reference voltage select switch RVCSWb may selectively couple a line of the first reference voltage VREF1 or a line of the second reference voltage VREF2 to the input terminal of the input buffer IB in response to the reference voltage control signal SRVC. For example, in a case where a gamma voltage VGMAN is less than or equal to the first reference voltage VREF1, the reference voltage select circuit 240*a* may generate the reference voltage control signal SRVC having a first level, the reference voltage control switch RVCSWb may couple the line of the first reference voltage VREF1 to the input terminal of the input buffer IB in response to the reference voltage control signal SRVC having the first level, and the input buffer IB may provide the first reference voltage VREF1 to the DAC circuit 260. Further, in a case where the gamma voltage VGMAN is greater than the first reference voltage VREF1, the reference voltage select circuit 240*a* may generate the reference voltage control signal SRVC having a second level, the reference voltage control switch RVCSWb may couple the line of the second reference voltage VREF2 to the input terminal of the input buffer IB in response to the reference voltage control signal SRVC having the second level, and the input buffer IB may provide the second reference voltage VREF2 to the DAC circuit 260. Accordingly, the gamma generation circuit 200*c* may generate the gamma voltage VGMAN by using an optimal reference voltage among the first and second reference voltages VREF1 and VREF2.

Figure 8:
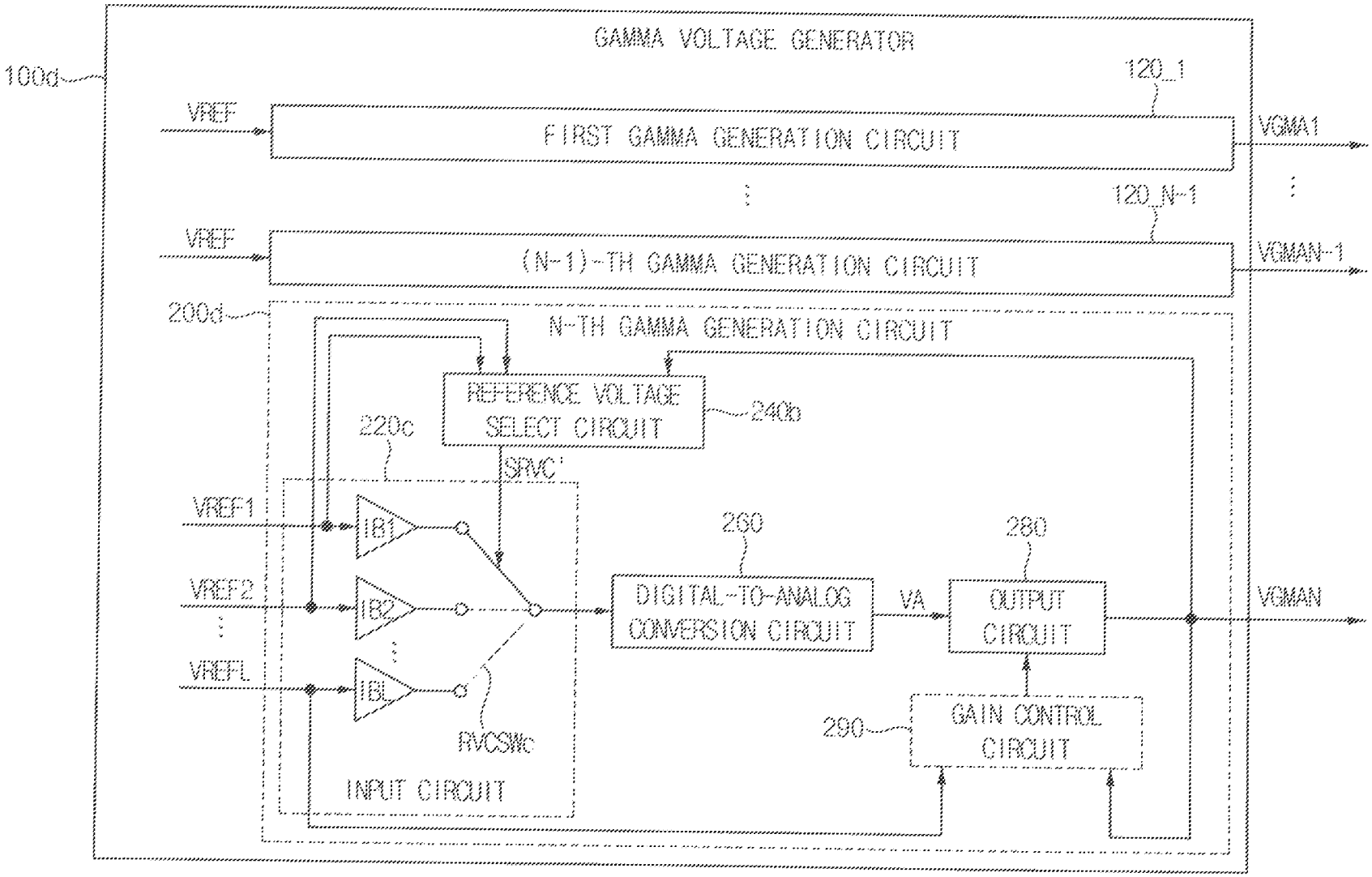
FIG. 8 is a block diagram illustrating a gamma voltage generator according to embodiments.

FIG. 8 is a block diagram illustrating a gamma voltage generator according to embodiments.

Referring to FIG. 8, a gamma voltage generator 100*d* according to embodiments may include a plurality of gamma generation circuits 120_1, . . . , 120_N−1 and 200*d* that respectively generate a plurality of gamma voltages VGMA1, . . . , VGMAN−1 and VGMAN. At least one gamma generation circuit 200*d* of the plurality of gamma generation circuits 120_1, . . . , 120_N−1 and 200*d* may include an input circuit 220*c*, a reference voltage select circuit 240*b*, a DAC circuit 260 and an output circuit 280. In some embodiments, the gamma generation circuit 200*d* may further include a gain control circuit 290. The gamma voltage generator 100*d* of FIG. 8 may have a similar configuration and a similar operation to a gamma voltage generator 100*a* of FIG. 1, a gamma voltage generator 100*b* of FIG. 2 or a gamma voltage generator 100*c* of FIG. 7, except that the gamma generation circuit 200*d* may receive L reference voltages VREF1, VREF2, . . . , VREFL, where L is an integer greater than 1, and may generate a gamma voltage VGMAN by selectively using the L reference voltages VREF1, VREF2, . . . , VREFL.

The input circuit 220*c* may receive first through L-th reference voltages VREF1, VREF2, . . . , VREFL, and may provide a reference voltage selected among the first through L-th reference voltages VREF1, VREF2, . . . , VREFL to the DAC circuit 260 in response to a reference voltage control signal SRVC' of the reference voltage select circuit 240*b*. In some embodiments, as illustrated in FIG. 8, the input circuit 220*c* may include first through L-th input buffers IB1, IB2, . . . , IBL respectively receiving the first through L-th reference voltages VREF1, VREF2, . . . , VREFL, and a reference voltage select switch RVCSWc that couples an input buffer selected among the first through L-th input buffers IB1, IB2, . . . , IBL to the DAC circuit 260 to the DAC circuit 260 in response to the reference voltage control signal SRVC'. In other embodiments, the input circuit 220*c* may include one input buffer, and a reference voltage select switch that couples a line selected among lines of the first through L-th reference voltages VREF1, VREF2, . . . , VREFL to an input terminal of the one input buffer in response to the reference voltage control signal SRVC'.

The reference voltage select circuit 240*b* may select one of the first through L-th reference voltages VREF1, VREF2, . . . , VREFL by comparing the gamma voltage VGMAN with the first through L-th reference voltages VREF1, VREF2, . . . , VREFL. In some embodiments, the reference voltage select circuit 240*b* may select a reference voltage that is higher than or equal to the gamma voltage VGMAN and is closest to the gamma voltage VGMAN among the first through L-th reference voltages VREF1, VREF2, . . . , VREFL. Accordingly, the gamma generation circuit 200*d* may generate the gamma voltage VGMAN by using an optimal reference voltage among first through L-th reference voltages VREF1, VREF2, . . . , VREFL.

Figure 9:
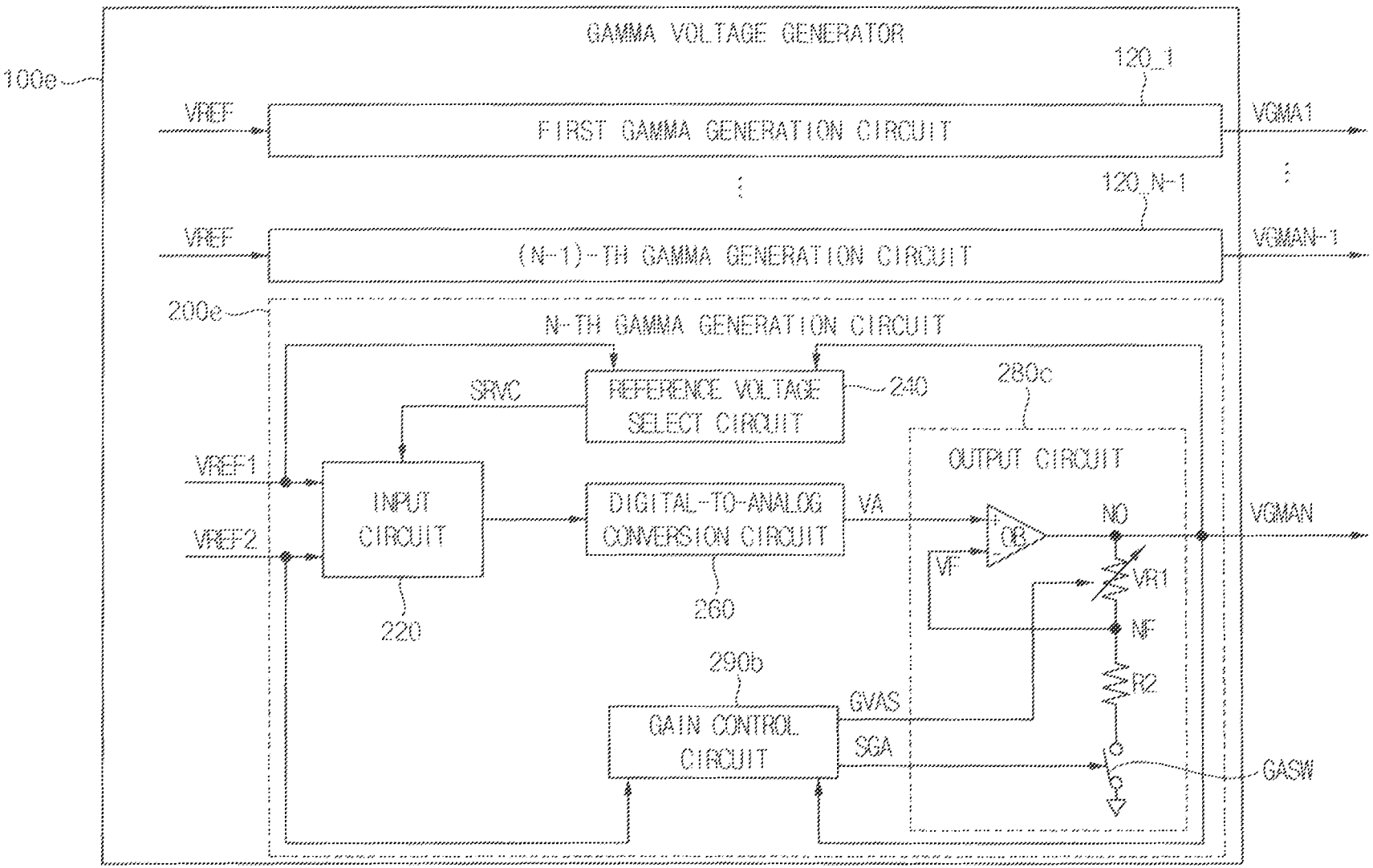
FIG. 9 is a block diagram illustrating a gamma voltage generator according to embodiments.

FIG. 9 is a block diagram illustrating a gamma voltage generator according to embodiments.

Referring to FIG. 9, a gamma voltage generator 100*e* according to embodiments may include a plurality of gamma generation circuits 120_1, . . . , 120_N−1 and 200*e* that respectively generate a plurality of gamma voltages VGMA1, . . . , VGMAN−1 and VGMAN. At least one gamma generation circuit 200*e* of the plurality of gamma generation circuits 120_1, . . . , 120_N−1 and 200*e* may include an input circuit 220, a reference voltage select circuit 240, a DAC circuit 260, an output circuit 280*c* and a gain control circuit 290*b*. The gamma voltage generator 100*e* of FIG. 9 may have a similar configuration and a similar operation to a gamma voltage generator 100*a* of FIG. 1, a gamma voltage generator 100*b* of FIG. 2, a gamma voltage generator 100*c* of FIG. 7 or a gamma voltage generator 100*d* of FIG. 8, except that a value of a gain of the output circuit 280*c* may be adjustable, and the gain of the output circuit 280*c* may be selectively applied.

The gain control circuit 290*b* may generate a gain value adjustment signal GVAS for adjusting the value of the gain of the output circuit 280*c*, and a gain application signal SGA for selectively applying the gain of the output circuit 280*c* by comparing a gamma voltage VGMAN with a second reference voltage VREF2. The value of the gain of the output circuit 280*c* may be adjusted in response to the gain value adjustment signal GVAS, and the gain of the output circuit 280*c* may be selectively applied in response to the gain application signal SGA.

In some embodiments, as illustrated in FIG. 9, the output circuit 280*c* may include an output buffer OB, a first resistor VR1, a second resistor R2 and a gain application switch GASW. The output buffer OB may include a first input terminal for receiving an analog voltage VA, a second input terminal coupled to a feedback node NF, and an output terminal coupled to an output node NO at which the gamma voltage VGMAN is output. The first resistor VR1 may include a first terminal coupled to the output node NO, and a second terminal coupled to the feedback node NF, and may have a variable resistance value that is changed in response to the gain value adjustment signal GVAS. The second resistor R2 may include a first terminal coupled to the feedback node NF, and a second terminal. The gain application switch GASW may selectively couple the second terminal of the second resistor R2 to a power supply voltage line in response to the gain application signal SGA. The output circuit 280*c* may have a gain of "(VR1+R2)/R2". Thus, if a resistance value of the first resistor VR1 is changed, the gain of the output circuit 280*c* may be changed. Although FIG. 9 illustrates an example where the first resistor VR1 has the variable resistance value, in other embodiments, the second resistor R2 may have the variable resistance value, or both of the first and second resistors R1 and R2 may have the variable resistance value.

Figure 10:
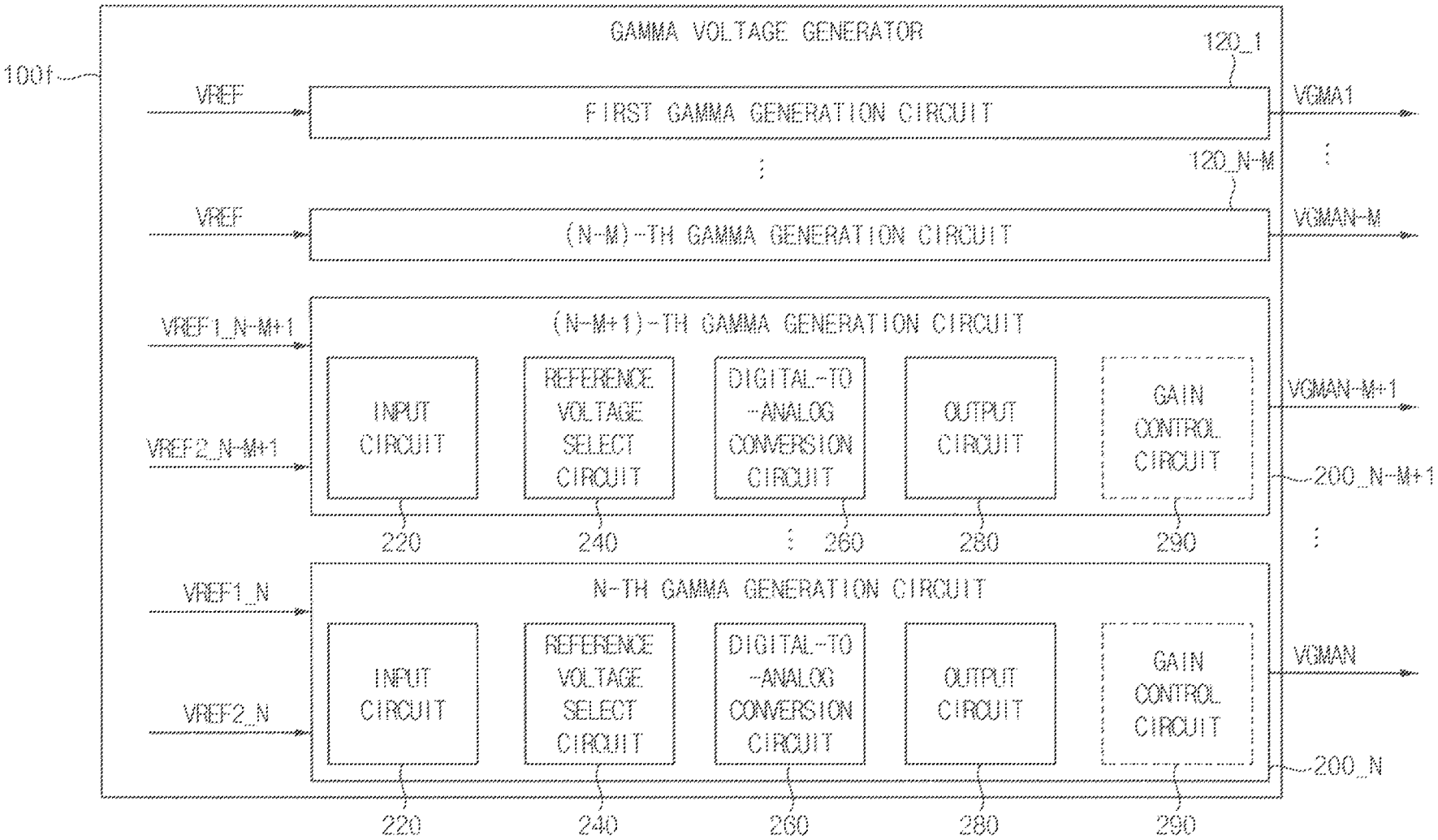
FIG. 10 is a block diagram illustrating a gamma voltage generator according to embodiments.
Figure 11:
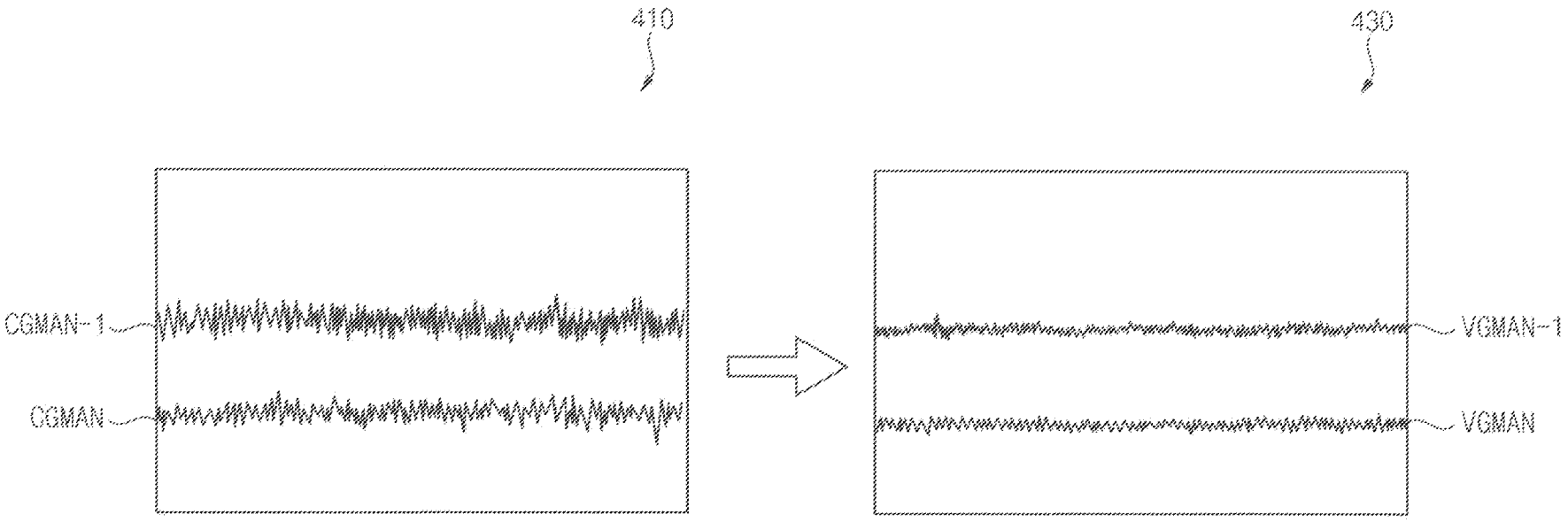
FIG. 11 is a diagram illustrating a portion of gamma voltages generated by a conventional gamma voltage generator and a portion of gamma voltages generated by a gamma voltage generator according to embodiments.

FIG. 10 is a block diagram illustrating a gamma voltage generator according to embodiments, and FIG. 11 is a diagram illustrating a portion of gamma voltages generated by a conventional gamma voltage generator and a portion of gamma voltages generated by a gamma voltage generator according to embodiments.

Referring to FIG. 10, a gamma voltage generator 100*f* according to embodiments may include first through N-th gamma generation circuits 120_1, . . . , 120_N−M, 200_N−M+1, . . . , 200_N that respectively generate first through N-th gamma voltages VGMA1, . . . , VGMAN−M, VGMAN−M+1, . . . , VGMAN. Unlike gamma voltage generators 100*a*, 100*b*, 100*c*, 100*d* and 100*e* of FIGS. 1, 2, 7, 8 and 9 where one gamma generation circuit 200*a*, 200*b*, 200*c*, 200*d* and 200*e* that generates the lowest gamma voltage VGMAN may receive two or more reference voltages, in the gamma voltage generator 100*f* of FIG. 10, each of M gamma generation circuits 200_N−M+1, . . . , 200_N that generate lowest M gamma voltages VGMAN−M+1, . . . , VGMAN among the first through N-th gamma voltages VGMA1, . . . , VGMAN−M, VGMAN−M+1, . . . , VGMAN may receive two or more reference voltages VREF1_N−M+1, VREF2_N−M+1, . . . , VREF1_N and VREF2_N.

Each of the first through (N−M)-th gamma generation circuits 120_1, . . . , 120_N−M may generate a gamma voltage VGMA1, . . . , VGMAN−M by using one reference voltage VREF. However, each of (N−M+1)-th through N-th gamma generation circuits 200_N−M+1, . . . , 200_N may receive two or more reference voltages VREF1_N−M+1, VREF2_N−M+1, . . . , VREF1_N and VREF2_N, and may generate a gamma voltage VGMAN−M+1, . . . , VGMAN by selectively using the two or more reference voltages VREF1_N−M+1, VREF2_N−M+1, . . . , VREF1_N and VREF2_N. For example, each of the (N−M+1)-th through N-th gamma generation circuits 200_N−M+1, . . . , 200_N may include an input circuit 220, a reference voltage select circuit 240, a DAC circuit 260 and an output circuit 280. In some embodiments, each of the (N−M+1)-th through N-th gamma generation circuits 200_N−M+1, . . . , 200_N may further include a gain control circuit 290.

As illustrated in a first graph 410 of FIG. 11, (N−1)-th and N-th gamma voltages CGMAN−1 and CGMAN generated by a conventional gamma voltage generator may have large ripples or may fluctuate. Accordingly, in a display device including the conventional gamma voltage generator, a flicker may occur (in particular, when a low gray image is displayed). However, as illustrated in a second graph 430 of FIG. 11, (N−1)-th and N-th gamma voltages VGMAN−1 and VGMAN generated by the gamma voltage generator 100*f* according to embodiments may have smaller ripples or may fluctuate less than gamma voltages generated by a conventional gamma voltage generator. Accordingly, a flicker of a display device including the gamma voltage generator 100*f* may be reduced.

Figure 12:
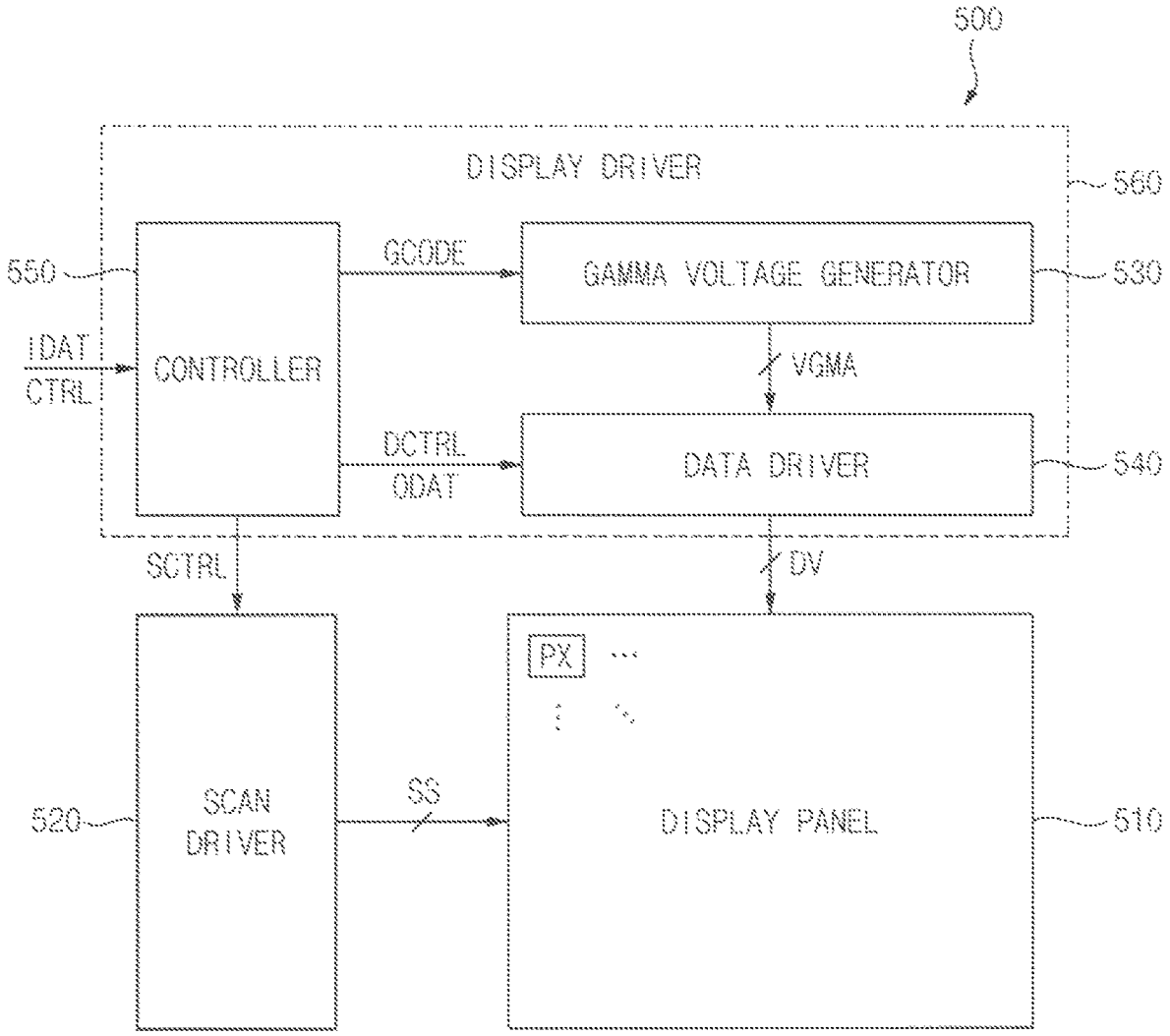
FIG. 12 is a block diagram illustrating a display device according to embodiments.

FIG. 12 is a block diagram illustrating a display device according to embodiments.

Referring to FIG. 12, a display device 500 according to embodiments may include a display panel 510 that includes a plurality of pixels PX, and a display driver 560 that drives the display panel 510. In some embodiments, the display driver 560 may include a gamma voltage generator 530 that generates a plurality of gamma voltages VGMA, a data driver 540 that provides data voltages DV to the plurality of pixels PX based on the plurality of gamma voltages VGMA, and a controller 550 that controls an operation of the display device 500. In some embodiments, the display device 500 may further include a scan driver 520 that provides scan signals SS to the plurality of pixels PX.

The display panel 510 may include a plurality of data lines, a plurality of scan lines, and the plurality of pixels PX coupled to the plurality of data lines and the plurality of scan lines. In some embodiments, each pixel PX may include a light emitting element, and the display panel 510 may be a light emitting display panel. For example, the light emitting element may be an organic light emitting diode (OLED), and the display panel 510 may be an OLED display panel. In other embodiments, the light emitting element may be a nano light emitting diode (NED), a quantum dot (QD) light emitting diode, a micro light emitting diode, an inorganic light emitting diode, or any other suitable light emitting element. In other embodiments, each pixel PX may include a switching transistor, and a liquid crystal capacitor coupled to the switching transistor, and the display panel 510 may be a liquid crystal display (LCD) panel. However, the display panel 510 is not limited to the light emitting display panel the LCD panel, and may be any other suitable display panel.

The scan driver 520 may generate the scan signals SS based on a scan control signal SCTRL received from the controller 550, and may sequentially provide the scan signals SS to the plurality of pixels PX on a row-by-row basis through the plurality of scan lines. In some embodiments, the scan control signal SCTRL may include, but not limited to, a scan start signal and a scan clock signal. In some embodiments, the scan driver 520 may be integrated or formed in a peripheral portion of the display panel 510. In other embodiments, the scan driver 520 may be implemented with one or more integrated circuits.

The gamma voltage generator 530 may include a plurality of gamma generation circuits that respectively generate the plurality of gamma voltages VGMA corresponding to gamma codes GCODE received from the controller 550. According to embodiments, the gamma voltage generator 530 may be a gamma voltage generator 100*a* of FIG. 1, a gamma voltage generator 100*b* of FIG. 2, a gamma voltage generator 100*c* of FIG. 7, a gamma voltage generator 100*d* of FIG. 8, a gamma voltage generator 100*e* of FIG. 9, a gamma voltage generator 100*f* of FIG. 10, or the like. At least one gamma generation circuit of the plurality of gamma generation circuits may receive a plurality of reference voltages, and may generate the gamma voltage VGMA by using an optimal reference voltage among the plurality of reference voltages. Accordingly, a ripple or a fluctuation of the gamma voltage VGMA may be reduced, a ripple or a fluctuation of the data voltages DV generated based on the gamma voltage VGMA may be reduced, and thus a flicker of the display device 500 may be reduced. In some embodiments, the display driver 560 may be implemented with a single integrated circuit (e.g., a timing controller embedded data driver (TED) integrated circuit), and the gamma voltage generator 530 may be implemented with the single integrated circuit. In other embodiments, the gamma voltage generator 530 may be implemented with a PMIC for generating voltages required for the display device 500. In still other embodiments, the gamma voltage generator 530 may be implemented as an integrated circuit other than the PMIC.

The data driver 540 may receive output image data ODAT and a data control signal DCTRL from the controller 550, may receive the plurality of gamma voltages VGMA from the gamma voltage generator 530, may generate gray voltages respectively corresponding to a plurality of gray levels (e.g., 256 gray levels from a 0-gray level to a 255-gray level) based on the plurality of gamma voltages VGMA, and may provide the gray voltages corresponding to the output image data ODAT as the data voltages DV to the plurality of pixels PX through the plurality of data lines. In some embodiments, the data control signal DCTRL may include, but not limited to, an output data enable signal, a horizontal start signal and a load signal. In some embodiments, the data driver 540 and the controller 550 may be implemented with a single integrated circuit, and the single integrated circuit may be referred to as the TED integrated circuit. In other embodiments, the data driver 540 and the controller 550 may be implemented with separate integrated circuits.

The controller 550 (e.g., a timing controller (TCON)) may receive input image data IDAT and a control signal CTRL from an external host processor (e.g., an application processor (AP), a graphics processing unit (GPU) or a graphics card). In some embodiments, the input image data IDAT may be, but not limited to, RGB image data including red image data, green image data and blue image data. The control signal CTRL may include, but not limited to, a vertical synchronization signal, a horizontal synchronization signal, an input data enable signal, a master clock signal, etc. The controller 550 may generate the output image data ODAT, the data control signal DCTRL and the scan control signal SCTRL based on the input image data IDAT and the control signal CTRL. The controller 550 may control an operation of the data driver 540 by providing the output image data ODAT and the data control signal DCTRL to the data driver 540, and may control an operation of the scan driver 520 by providing the scan control signal SCTRL to the scan driver 520.

Figure 13:
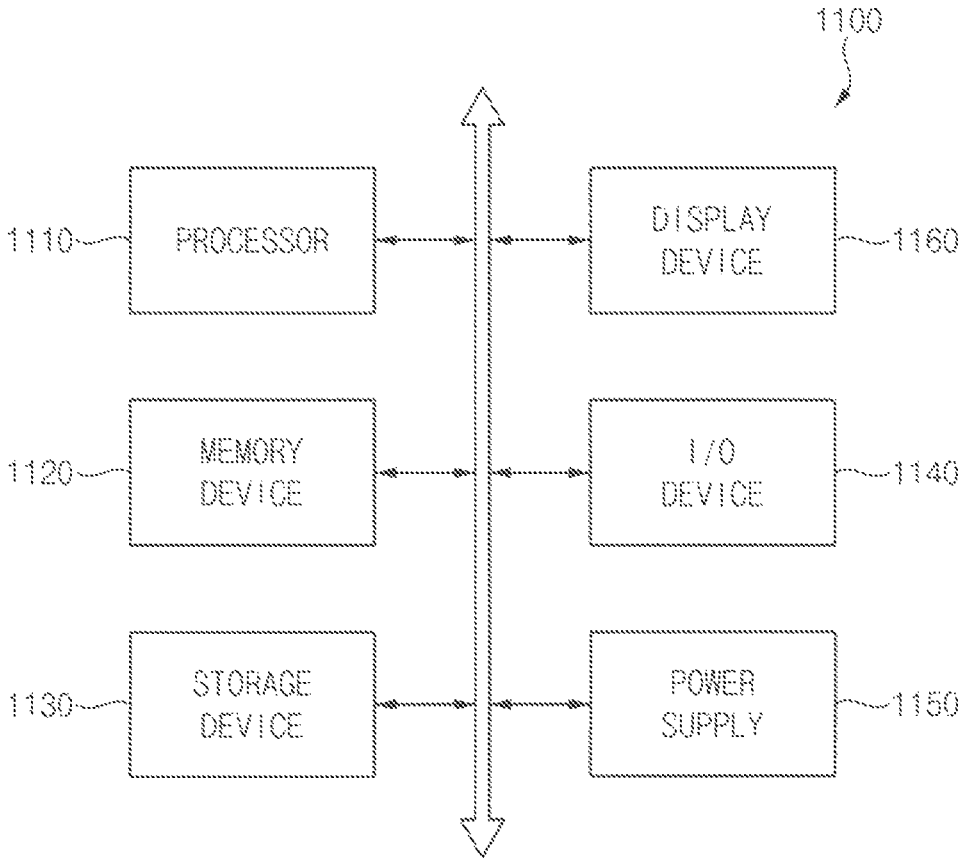
FIG. 13 is a block diagram illustrating an electronic device including a display device according to embodiments.

FIG. 13 is a block diagram illustrating an electronic device including a display device according to embodiments.

Referring to FIG. 13, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

In the display device 1160, at least one gamma generation circuit may receive a plurality of reference voltages, and may generate a gamma voltage by using an optimal reference voltage among the plurality of reference voltages. Accordingly, a ripple or a fluctuation of the gamma voltage may be reduced, a ripple or a fluctuation of data voltages generated based on the gamma voltage may be reduced, and thus a flicker of the display device 1160 may be reduced.

The inventive concepts may be applied to any display device 1160, and any electronic device 1100 including the display device 1160. For example, the inventive concepts may be applied to a mobile phone, a smart phone, a tablet computer, a wearable electronic device, a virtual reality (VR) device, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A gamma voltage generator comprising:

a plurality of gamma generation circuits configured to generate a plurality of gamma voltages, respectively, wherein at least one gamma generation circuit of the plurality of gamma generation circuits comprises:

an input circuit configured to receive a first reference voltage and a second reference voltage;

a reference voltage select circuit configured to select a reference voltage among the first reference voltage and the second reference voltage by comparing a gamma voltage generated by the at least one gamma generation circuit with at least one of the first reference voltage and the second reference voltage;

a digital-to-analog conversion circuit configured to generate an analog voltage corresponding to a gamma code based on the reference voltage selected by the reference voltage select circuit; and an output circuit configured to output the gamma voltage based on the analog voltage.

2. The gamma voltage generator of claim 1, wherein the at least one gamma generation circuit selectively receives two or more reference voltages including the first reference voltage and the second reference voltage, and wherein each of remaining gamma generation circuits other than the at least one gamma generation circuit among the plurality of gamma generation circuits receives a fixed reference voltage.

3. The gamma voltage generator of claim 1, wherein the second reference voltage is higher than the first reference voltage, and wherein the reference voltage select circuit selects the first reference voltage among the first reference voltage and the second reference voltage in a case where the gamma voltage is less than or equal to the first reference voltage, and selects the second reference voltage among the first reference voltage and the second reference voltage in a case where the gamma voltage is greater than the first reference voltage.

4. The gamma voltage generator of claim 1, wherein the first reference voltage is a band gap reference (BGR) voltage that is generated by a BGR circuit, and wherein the second reference voltage is a logic voltage that is higher than the BGR voltage and that is supplied to a logic circuit.

5. The gamma voltage generator of claim 1, wherein the input circuit includes:

a first input buffer configured to receive the first reference voltage through an input terminal and to output the first reference voltage through an output terminal;

a second input buffer configured to receive the second reference voltage through an input terminal and to output the second reference voltage through an output terminal; and a reference voltage control switch configured to selectively couple the output terminal of the first input buffer or the output terminal of the second input buffer to the digital-to-analog conversion circuit in response to a reference voltage control signal.

6. The gamma voltage generator of claim 1, wherein the digital-to-analog conversion circuit includes:

a resistor string configured to generate a plurality of analog voltages by dividing the selected reference voltage; and an analog voltage select circuit configured to select one of the plurality of analog voltages in response to the gamma code.

7. The gamma voltage generator of claim 1, wherein the output circuit includes:

an output buffer configured to receive the analog voltage, and to output the analog voltage as the gamma voltage.

8. The gamma voltage generator of claim 1, wherein the second reference voltage is higher than the first reference voltage, wherein, in a case where the gamma voltage is less than or equal to the first reference voltage, the at least one gamma generation circuit does not apply a gain of the output circuit and generates the gamma voltage by using the first reference voltage, wherein, in a case where the gamma voltage is greater than the first reference voltage and less than or equal to the second reference voltage, the at least one gamma generation circuit does not apply the gain of the output circuit and generates the gamma voltage by using the second reference voltage, and wherein, in a case where the gamma voltage is greater than the second reference voltage, the at least one gamma generation circuit generates the gamma voltage by using the second reference voltage and by applying the gain of the output circuit.

9. The gamma voltage generator of claim 8, wherein the reference voltage select circuit outputs the gamma voltage substantially the same as the analog voltage in a case where the gain of the output circuit is not applied, and outputs the gamma voltage generated by multiplying the analog voltage by the gain of the output circuit in a case where the gain of the output circuit is applied.

10. The gamma voltage generator of claim 1, wherein the at least one gamma generation circuit further comprises:

a gain control circuit configured to control the output circuit such that a gain of the output circuit is selectively applied by comparing the gamma voltage with the second reference voltage.

11. The gamma voltage generator of claim 10, wherein the gain control circuit controls the output circuit to output the analog voltage as the gamma voltage in a case where the gamma voltage is less than or equal to the second reference voltage, and controls the output circuit to generate the gamma voltage by multiplying the analog voltage by the gain of the output circuit in a case where the gamma voltage is greater than the second reference voltage.

12. The gamma voltage generator of claim 10, wherein the output circuit includes:

an output buffer including a first input terminal for receiving the analog voltage, a second input terminal coupled to a feedback node, and an output terminal coupled to an output node at which the gamma voltage is output;

a first resistor including a first terminal coupled to the output node, and a second terminal coupled to the feedback node;

a second resistor including a first terminal coupled to the feedback node, and a second terminal; and a gain application switch configured to selectively couple the second terminal of the second resistor to a power supply voltage line in response to a gain application signal output from the gain control circuit.

13. The gamma voltage generator of claim 1, wherein the input circuit includes:

an input buffer including an input terminal and an output terminal coupled to the digital-to-analog conversion circuit; and a reference voltage select switch configured to selectively couple a line of the first reference voltage or a line of the second reference voltage to the input terminal of the input buffer in response to a reference voltage control signal.

14. The gamma voltage generator of claim 1, wherein the input circuit receives L reference voltages including the first reference voltage and the second reference voltage, where L is an integer greater than 1, and wherein the reference voltage select circuit selects the reference voltage among the L reference voltages by comparing the gamma voltage with the L reference voltages.

15. The gamma voltage generator of claim 1, wherein the at least one gamma generation circuit further comprises:

a gain control circuit configured to generate a gain value adjustment signal for adjusting a value of a gain of the output circuit, and a gain application signal for selectively applying the gain of the output circuit by comparing the gamma voltage with the second reference voltage.

16. The gamma voltage generator of claim 15, wherein the output circuit includes:

an output buffer including a first input terminal for receiving the analog voltage, a second input terminal coupled to a feedback node, and an output terminal coupled to an output node at which the gamma voltage is output;

a first resistor including a first terminal coupled to the output node, and a second terminal coupled to the feedback node, and having a variable resistance value that is changed in response to the gain value adjustment signal;

a second resistor including a first terminal coupled to the feedback node, and a second terminal; and a gain application switch configured to selectively couple the second terminal of the second resistor to a power supply voltage line in response to the gain application signal.

17. The gamma voltage generator of claim 1, wherein the plurality of gamma generation circuits is N gamma generation circuits, where N is an integer greater than 1, wherein each of M gamma generation circuits among the N gamma generation circuits selectively receives two or more reference voltages, where M is an integer greater than 0 and less than N, and wherein each of N−M gamma generation circuits other than the M gamma generation circuits among the N gamma generation circuits receives a fixed reference voltage.

18. A display driver for driving a display panel, the display driver comprising:

a gamma voltage generator including a plurality of gamma generation circuits that respectively generate a plurality of gamma voltages; and a data driver configured to generate data voltages based on the plurality of gamma voltages and to provide the data voltages to the display panel, wherein at least one gamma generation circuit of the plurality of gamma generation circuits comprises:

an input circuit configured to receive a first reference voltage and a second reference voltage;

a reference voltage select circuit configured to select a reference voltage among the first reference voltage and the second reference voltage by comparing a gamma voltage generated by the at least one gamma generation circuit with at least one of the first reference voltage and the second reference voltage;

a digital-to-analog conversion circuit configured to generate an analog voltage corresponding to a gamma code based on the reference voltage selected by the reference voltage select circuit; and an output circuit configured to output the gamma voltage based on the analog voltage.

19. The display driver of claim 18, wherein the second reference voltage is higher than the first reference voltage, wherein the at least one gamma generation circuit further comprises:

a gain control circuit configured to control the output circuit such that a gain of the output circuit is selectively applied by comparing the gamma voltage with the second reference voltage, wherein, in a case where the gamma voltage is less than or equal to the first reference voltage, the at least one gamma generation circuit generates the gamma voltage by using the first reference voltage, wherein, in a case where the gamma voltage is greater than the first reference voltage and less than or equal to the second reference voltage, the at least one gamma generation circuit generates the gamma voltage by using the second reference voltage, and wherein, in a case where the gamma voltage is greater than the second reference voltage, the at least one gamma generation circuit generates the gamma voltage by using the second reference voltage and by applying the gain of the output circuit.

20. A display device comprising:

a display panel including a plurality of pixels;

a scan driver configured to provide scan signals to the plurality of pixels;

a gamma voltage generator including a plurality of gamma generation circuits that respectively generate a plurality of gamma voltages;

a data driver configured to generate data voltages based on the plurality of gamma voltages, and to provide the data voltages to the plurality of pixels; and a controller configured to control the scan driver, the gamma voltage generator and the data driver, wherein at least one gamma generation circuit of the plurality of gamma generation circuits comprises:

an input circuit configured to receive a first reference voltage and a second reference voltage;

a reference voltage select circuit configured to select a reference voltage among the first reference voltage and the second reference voltage by comparing a gamma voltage generated by the at least one gamma generation circuit with at least one of the first reference voltage and the second reference voltage;

a digital-to-analog conversion circuit configured to generate an analog voltage corresponding to a gamma code based on the reference voltage selected by the reference voltage select circuit; and an output circuit configured to output the gamma voltage based on the analog voltage.

21. The display device of claim 20, wherein the second reference voltage is higher than the first reference voltage, wherein the at least one gamma generation circuit further comprises:

a gain control circuit configured to control the output circuit such that a gain of the output circuit is selectively applied by comparing the gamma voltage with the second reference voltage, wherein, in a case where the gamma voltage is less than or equal to the first reference voltage, the at least one gamma generation circuit generates the gamma voltage by using the first reference voltage, wherein, in a case where the gamma voltage is greater than the first reference voltage and less than or equal to the second reference voltage, the at least one gamma generation circuit generates the gamma voltage by using the second reference voltage, and wherein, in a case where the gamma voltage is greater than the second reference voltage, the at least one gamma generation circuit generates the gamma voltage by using the second reference voltage and by applying the gain of the output circuit.

22. A method of generating a gamma voltage, the method comprising:

receiving a first reference voltage and a second reference voltage by a gamma generation circuit;

comparing a gamma voltage with at least one of the first reference voltage and the second reference voltage using the gamma generation circuit;

generating the gamma voltage by using the first reference voltage in a case where the gamma voltage is less than or equal to the first reference voltage using the gamma generation circuit;

generating the gamma voltage by using the second reference voltage in a case where the gamma voltage is greater than the first reference voltage and less than or equal to the second reference voltage using the gamma generation circuit; and generating the gamma voltage by using the second reference voltage and by applying a gain of an output circuit in a case where the gamma voltage is greater than the second reference voltage using the gamma generation circuit.

* * * * *